US005806115A

United States Patent [19]

Brown

[11] Patent Number: 5,806,115

[45] Date of Patent: Sep. 15, 1998

[54] PORTABLE, INTEGRATED, UNIVERSALLY ADJUSTABLE POSITION CONTROL SYSTEM

[75] Inventor: Bruce A. Brown, Tupelo, Miss.

[73] Assignee: Princeton Products, Clearwater, Fla.

[21] Appl. No.: 754,851

[22] Filed: Nov. 22, 1996

Related U.S. Application Data

[63] Continuation-in-part of Ser. No. 241,290, May 11, 1994, Pat. No. 5,577,278, which is a continuation-in-part of Ser. No. 916,636, Jul. 22, 1992, Pat. No. 5,311,625.

[51] Int. Cl.[6] ..... A61G 7/07

[52] U.S. Cl. ..... 5/615; 5/634; 297/377; 297/DIG. 8

[58] Field of Search ..... 5/607, 608, 609, 5/615, 634, 509.1; 297/377, DIG. 8

[56] References Cited

U.S. PATENT DOCUMENTS

| | | | |
|---|---|---|---|
| 3,781,928 | 1/1974 | Swallert | 5/615 |
| 4,127,906 | 12/1978 | Zur | 5/615 |
| 4,225,988 | 10/1980 | Cary et al. | 5/607 |
| 4,287,620 | 9/1981 | Zur | 5/608 X |
| 4,839,932 | 6/1989 | Williamson | 5/615 |
| 5,303,437 | 4/1994 | Hung | 5/607 X |
| 5,425,150 | 6/1995 | Palmer, Jr. et al. | 5/615 |

*Primary Examiner*—Michael F. Trettel
*Attorney, Agent, or Firm*—Melvin I. Stoltz

[57] ABSTRACT

By providing position control means cooperatively associated with a support pad with said control means being constructed for arcuately moving the support pad in response to activation by the user, with the position control means and pad peripherally surrounded by a cover, a unique, portable, self-contained, unitary, movably adjustable support assembly is attained whereby individuals are able to position the support pad in any desired location or on any surface while also being able to automatically raise and/or lower the support pad to any position for comfort and support. In the preferred embodiment, the movably adjustable support assembly is constructed with expandable shroud means integrally connected with the cover in association with the position control means for expanding in response to the arcuate movement of the position control means while being automatically retracted into a folded configuration when the control means are returned to its original position. In addition, the present invention incorporates a single air flow control assembly which is capable of directly controlling two separate and independent movably adjustable support assemblies, each of which employ separate control means. In this way, individuals with queen or king sized beds are able to employ two separate and independent movably adjustable support assemblies on the single bed for separate and independent control, while employing a single air flow control assembly.

9 Claims, 19 Drawing Sheets

FIG. 6
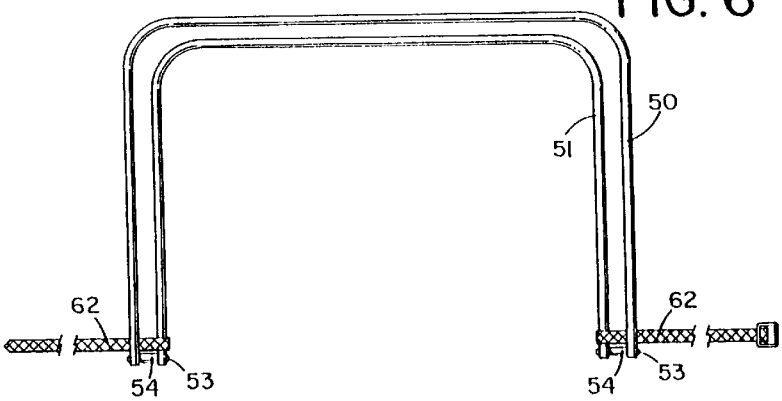
FIG. 7
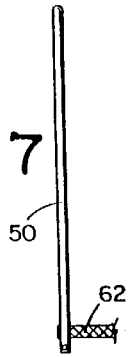
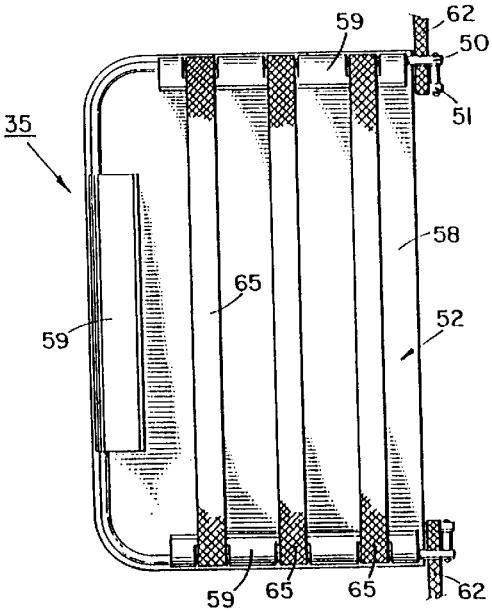
FIG. 8
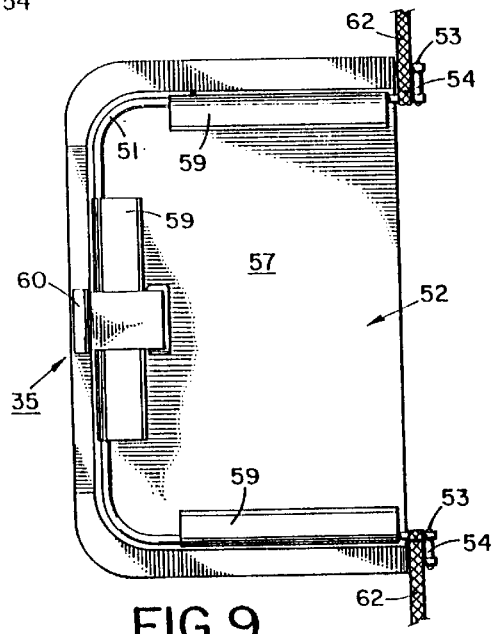
FIG. 9
FIG. 10
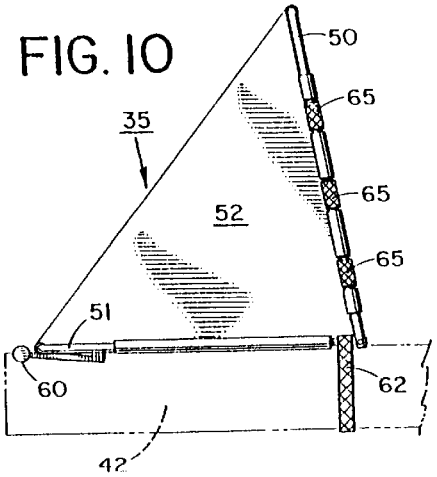
FIG. 11
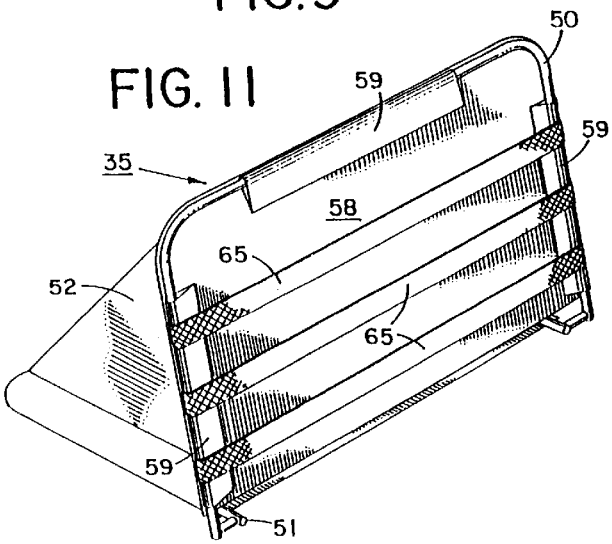

PORTABLE, INTEGRATED, UNIVERSALLY ADJUSTABLE POSITION CONTROL SYSTEM

This application is a continuation-in-part application of U.S. Ser. No. 08/241,290, filed on May 11, 1994, now U.S. Pat. No. 5,577,278, which is a continuation-in-part application of U.S. Ser. No. 07/916,636, filed Jul. 22, 1992, now U.S. Pat. No. 5,311,625, issuing on May 17, 1994.

TECHNICAL FIELD

This invention relates to adjustable support systems and, more particularly, to a universally adjustable, portable self-contained support system enabling multi-position adjusting for both the back and/or legs of the user.

BACKGROUND ART

In order to meet a continuing consumer demand for comfort when individuals are in a prone or lying position, whether lying in bed, on a couch, on a floor, or any other location, numerous prior art constructions have been developed. Typically, these prior art configurations comprise either very expensive, complex movable bed frame constructions or inexpensive, adjustable back rests or fixed position inflation devices. However, no moderately priced system exists which is able to provide the comfort of a bed system, without its cost or complexity while also providing a system which is capable of being used in any desired location.

The inexpensive back rests, while often usable in various locations, merely have fixed positions or movable cushion or pad constructions which attempt to provide comfort by elevating an individual's back at a desired angle to the ground or to the bed on which the structure is mounted. While providing some comfort, these systems are incapable of providing the full-body support and range of positions which consumer's are seeking. Consequently, although numerous prior art constructions have been developed, none of these prior art cushions, pads, or adjustable back rests, have been capable of satisfying or meeting the consumer's needs and wants.

As an alternate to these back rest constructions, other prior art products have been developed for use in bed to enable the consumer to be partially elevated, with the back of the user supported in order to watch television or read more comfortably. Typically, these constructions employ air-inflation systems which either lie on top of the bed or are placed between the mattress and the box spring. However, these systems have similarly proved to be incapable of meeting the consumer's needs.

In particular, the prior art systems which lie on top of the bed must be removed prior to sleeping due to the bulkiness of the systems and the discomfort caused by the systems when not in use. The air inflation systems constructed for being placed underneath the mattress raise the entire mattress during their use. However, these systems, also, are removed by the consumer when lying flat, due to the discomfort caused by their bulk when not in use. Consequently, these prior art inflation systems have been incapable of meeting the consumer requirements.

Furthermore, these prior art air inflation systems have been specifically limited to being used either on or under a mattress. However, although additional comfort is realized when in the raised position, these systems are incapable of providing a system which is completely portable and enables its use in any desired location or in any desired surface, such as on the floor, couch or outdoors. Consequently, these prior art systems are extremely limited, and incapable of providing the full range of support and comfort the consumer is seeking.

The other prior art systems presently available, in an attempt to provide consumer's with complete comfort while in bed, are extremely expensive, motor-controlled, movable frame constructions having complex structures causing the mattress supporting frame to move or articulate in various directions upon command. Although these systems are capable of moving the mattress supported on the frame in a plurality of alternate positions and configurations, these prior art systems are limited in their ability, due to their inherent high cost as well as being usable only in a single location. Clearly, these prior art constructions are incapable of being moved to any desired location, as is desired.

Another inherent drawback with these expensive frame moving complex structures is their complete inability to attain a construction usable for a king-size or queen-size bed where both partners can independently and separately control the elevation of their back or leg supporting zones. Only by buying two separate systems are individuals able to approach independent control. However, such a requirement causes individuals to incur substantially added expense, while still not satisfying the consumer's needs and desires for an efficient, portable, self-contained, adjustable, construction which is reasonably priced.

Therefore, it is a principal object of the present invention to provide a multi-positionable, universally adjustable support system which is portable, self-contained, unitary in construction and enables multi-purpose use with both convenience and comfort.

Another object of the present invention is to provide a multi-positionable, universally adjustably support system having the characteristic features described above, which is inexpensive to manufacture while being substantially equivalent to expensive, complicated, mechanically operated bed raising systems.

Another object of the present invention is to provide the universally adjustable support system having the characteristic features described above which is sufficiently lightweight to be easily carried to any desired location for enabling the user to obtain the adjustable beneficial characteristics in any desired location or on any desired support surface.

A further object of the present invention is to provide the universally adjustable support system having the characteristic features described above which can also be permanently installed on a bed for use, when desired, while also being retained on the bed when not in use, without in any way interfering with the consumer's normal sleep habits.

Other and more specific objects will in part be obvious and will in part appear hereinafter.

SUMMARY OF THE INVENTION

In the present invention, the prior art drawbacks and difficulties are eliminated by providing a completely integrated, portable, position controlling system which comprises a unitary, adjustable, portable, self-contained, support assembly which incorporates two separate and independent adjustable sections integrally contained therein. In one section, typically used to support the back of the user, the support assembly is arcuately pivotable into virtually any desired position for supportingly maintaining the user in a particular elevated position. In another section, the support assembly is able to be elevated into a plurality of alternate configurations, in order to support the legs of the user in a raised position.

By providing a fully integrated unitary construction, a completely portable, universally adjustable support system is obtained which can be used in any desired location and on any desired surface. If desired, the support system of the present invention can be permanently installed on a bed to provide the user with the desired alternate positions when lying in bed, while also enabling the user to sleep with complete comfort on the system when in a fully horizontal position. As a result, a system is attained which does not have to be removed after use once installed on a bed, providing the benefits of prior art expensive equipment, while attaining all of these enhancements in a comparatively inexpensive construction.

One principal component incorporated into the fully integrated, adjustable support system of the present invention is the unitary, adjustable, portable, self-contained support assembly. This support assembly incorporates in a single, fully enclosed, unitary construction, a support pad, a bladder control frame assembly for raising and lowering the back supporting portion of the support pad, and an inflatable panel member for raising and lowering the leg supporting portion of the support pad. In addition, all of the components are fully enclosed within the unitary support assembly to assure complete portability of the support assembly and placement in any desired location for obtaining the comfortable positioning provided thereby.

In addition, the support assembly comprises shroud means peripherally surrounding and supportingly retaining and enclosing the bladder controlled frame assembly. In this way, the frame assembly is able to achieve its arcuate pivoting movement within the support assembly, without being outwardly visible. In addition, the shroud also incorporates elastic means formed thereon for maintaining the shroud in a compact configuration and assuring that any excess material is not visible. Furthermore, the elastic means also assures that the air inflated bladder of the bladder control frame system is easily returned from a fully expanded configuration to a fully contracted configuration, due to the elastic forces of the shroud assisting in forcing air out of the bladder, when so desired.

Another feature of the present invention is the attainment of a universally adjustable support system which is capable of being used by individuals having king or queen-size beds, with each individual being capable of complete independent control without affecting their partner. In the support system of this invention, individuals are able to select their own personally desired position for elevating either the back supporting portion or the foot supporting portion of the support assembly, while having virtually no effect on their partner. In prior art systems, no such dual independent control was possible without purchasing two separate, expensive systems.

In the present invention, separate, independent, movably adjustable, self-contained support assemblies are employed, with both support assemblies being movably adjustable by employing separate control means. In addition, both control means and both support assemblies are interconnected to a single air flow control assembly. As a result, a minimum of expensive components are employed and a dual, independent, fully adjustable position controlling system is attained for king size and queen-size beds.

The invention accordingly comprises the features of construction, combinations of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description taken in connection with the accompanying drawings in which:

FIG. 6 is a top plan view of the dual frame members incorporated into the support assembly of the present invention;

FIG. 7 is a side elevation view of the dual frame members of FIG. 6;

FIG. 8 is a top plan view of the bladder controlled frame assembly incorporated into the unitary, adjustable, portable, self-contained support assembly of the present invention;

FIG. 9 is a bottom plan view of the bladder controlled frame assembly of FIG. 8;

FIG. 10 is a side elevation view depicting the bladder controlled frame assembly of FIG. 8 in a fully inflated configuration;

FIG. 11 is a perspective view of the bladder controlled frame assembly of FIG. 10;

DETAILED DESCRIPTION

In FIGS. 1–5, integrated, portable, position controlling system 20 of the present invention is fully depicted. As shown therein, portable position controlling system 20 comprises unitary, self-contained, fully adjustable, portable support assembly 21, an air flow control assembly 22, and control means 23. Unitary adjustable support assembly 21 of position controlling system 20 is constructed for ease of portability and use in any desired location and on any desired support surface. In this way, the adjustable comfort provided by the present invention can be enjoyed anywhere desired.

Although the flexibility and portability of self-contained, unitary, adjustable support assembly 21 represents a principal unique aspect of position controlling system 20 of the present invention, its use and application on a conventional bed structure is one principal use for the present invention with which consumers are able to realize substantially enhanced bed elevating capabilities previously unobtainable. Consequently, this particular application is depicted throughout the drawings as the example for the use of this invention. However, this use of support assembly 21 represents a single application for support assembly 21 and is shown for exemplary purposes only, and is not intended, in any way, to limit the scope of the present invention.

Figure 1:
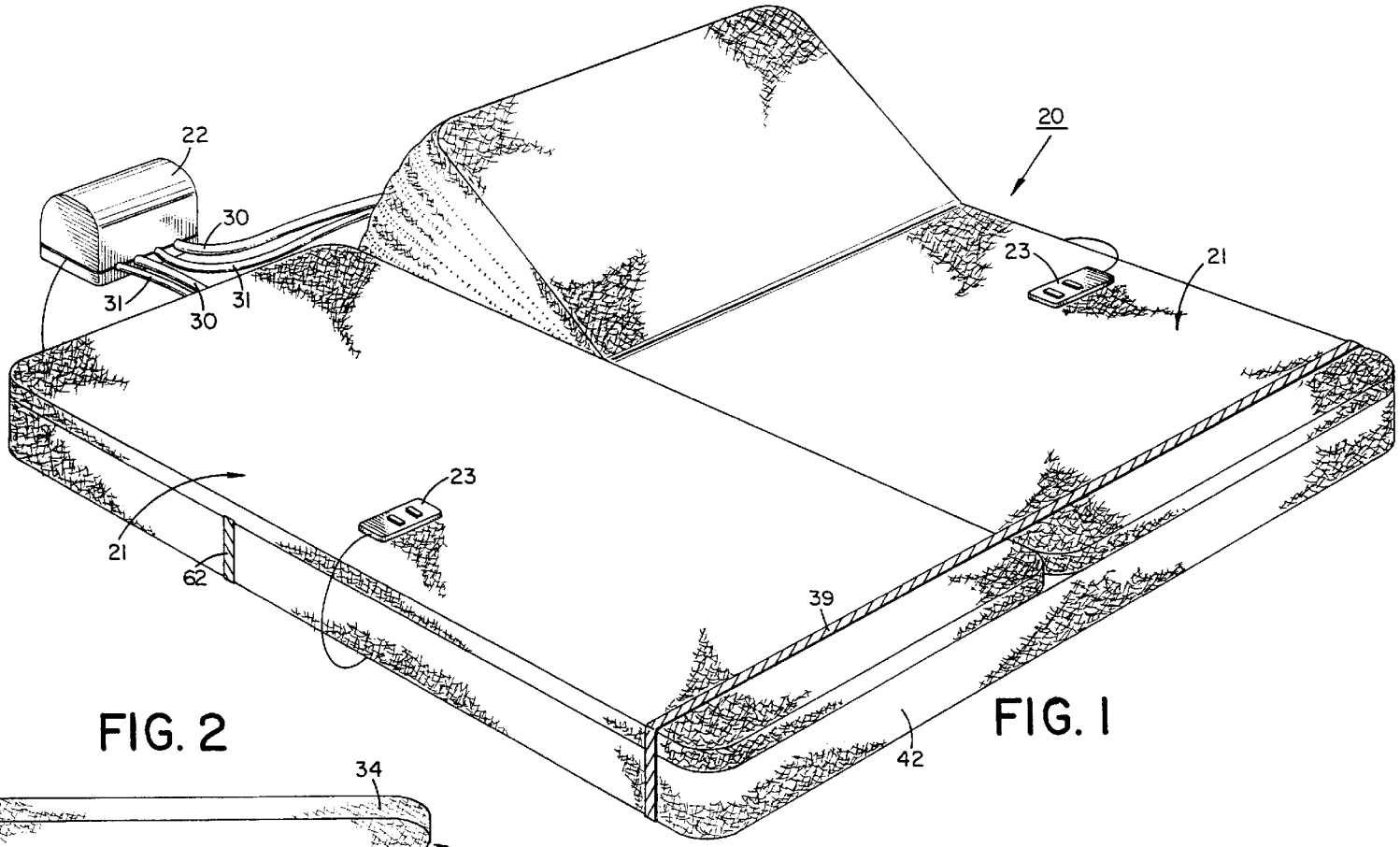
FIG. 1 is a perspective view of the integrated, portable, position controlling system of the present invention constructed for use on a king-size or queen-size bed to provide independent, movable, adjustability to both users thereof.

In FIG. 1, one of the principal features achieved in using the present invention on conventional beds is fully depicted. As shown therein, position controlling system 20 of the present invention provides complete, independent, self-controlled elevation to both the back-supporting portion and the leg-supporting portion of support assembly 21 to individuals having a king-size or queen-size bed without affecting their partner's side of the bed. In the prior art, no reasonably-priced system exists which allows individuals with king-size or queen-size beds to separately and independently control both a back supporting portion and a foot supporting portion of the bed while having no effect on their partner.

In the present invention, the independent control is achieved by employing two separate support assemblies 21, 21 with both support assemblies being independently interconnected to a single air flow control assembly 22. In this way, an integrated position controlling system 20 is achieved which reduces costs by eliminating duplication of equipment. In addition, the present invention enables individuals with king-size and queen-size beds to individually enjoy the benefits of comfortable position adjustability of both the back-supporting portion and the leg-supporting portion of support assembly 21, while having absolutely no effect or movement over their partner's separate and independent support assembly 21.

Each unitary, fully adjustable support assembly 21 is operated by channeling air flow into bladder members mounted within support assembly 21. In the preferred embodiment, one of the bladder members is constructed to enable the back-supporting portion of support assembly 21 to be pivotally adjusted into any desired position within an arc of about 80°. As a result, the user is able to movably position support assembly 21 into any desired position from completely horizontal to almost vertical. The second bladder member is constructed to enable the leg-supporting portion of support assembly 21 to be elevated and retained in a plurality of alternate positions ranging from completely horizontal to a raised level of about 10 inches above horizontal.

In order to assure complete, independent movement of each support assembly 21 upon demand, separate sets of air delivery hoses 30 and 31 are provided. Each pair of air delivery hoses 30 and 31 are separately connected to each of the two support assemblies 21, 21, thereby attaining the desired result, with a minimum of expensive components.

Finally, two separate control means 23, 23 are independently interconnected to air flow control assembly 22. As is fully detailed below, each control means 23 is constructed to enable the user to activate air flow control assembly 22 to enable either the back supporting portion or the leg-supporting portion of one support assembly 21 to be raised or lowered as desired. In this way, an individual using one of the support assemblies 21 is capable of activating air flow control assembly 22, to cause that support assembly 21 to be movably adjusted into any desired elevated position.

As is evident from FIG. 1, even when one support assembly 21 is activated and moved in a desired elevated position by one individual, that position is achieved completely independently of the second support assembly 21 and without having any effect on the adjacent support assembly 21. In this way, a fully integrated, position controlling system 20 is achieved which provides complete, independent, dual control thereof.

By referring to FIGS. 2, 3, 4, and 5, the construction details for attaining the unitary, adjustable, portable, self-contained support assembly 21 of this invention can best be understood. In the preferred embodiment, support assembly 21 comprises an elongated support pad or cushion 33 which defines the overall size and shape of support assembly 21. In addition, support assembly 21 also comprises a covering or layer of material 34 which overlies elongated support pad 33 and peripherally surrounds and envelopes elongated support pad 33. In addition, cover 34 shields support pad 33 from being seen, as well as shielding all of the remaining components mounted in association with pad 33 from being seen.

One component mounted in association with elongated support pad 33 is bladder controlled frame assembly 35, which is mounted at one end of support pad 33 in direct, overlying, covering contact with one surface thereof. At the opposed end of elongated support pad 33, inflatable panel member 36 is mounted with one surface thereof being in overlying, covering, contacting engagement with one surface of support pad 33.

The final component employed to complete the construction of support assembly 21 is shroud 37, which is mounted to cover 34 in a manner which peripherally surrounds and envelopes bladder control frame system 35. As is more fully detailed below, shroud 37 comprises elastic biasing means formed therewith, which normally maintains shroud 37 in a fully retracted position, while also enabling shroud 37 to expand in response to the movement of bladder controlled frame system 35.

Figure 5:
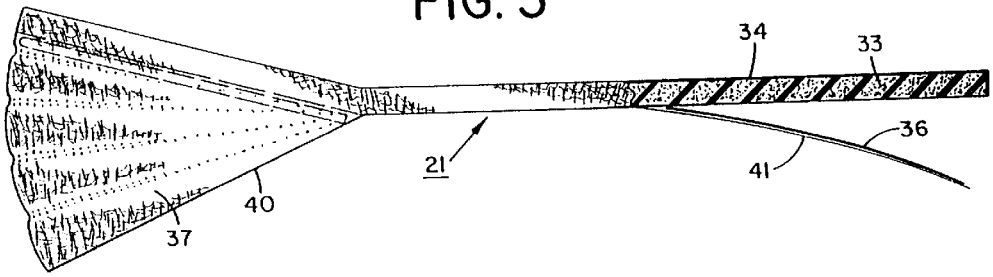
FIG. 5 is a side elevation view, partially in cross-section, depicting the construction of the unitary, adjustable, self-contained support assembly of the present invention.

As best seen in FIG. 5, the unitary, adjustable, portable, self-contained support assembly 21 of the present invention is preferably constructed by peripherally surrounding cover 34 about elongated support pad 33, with cover 34 peripherally surrounding and overlying substantially all surfaces of elongated support pad 33, except for the bottom surface at both ends of support pad 33. In these two uncovered areas, the free portion of cover 34 forms flaps 40 and 41.

In the construction of support assembly 21, inflatable panel member 36 is placed in overlying contacting engagement with flap 41 and, in the preferred embodiment, physically attached to flap 41 along the side edges of panel member 36. Then, flap 41 is affixed to the open ends of cover 34. In this way, inflatable panel member 36 is securely sealed within support assembly 21 in intimate, secured, controllable contacting engagement with one surface of elongated support pad 33.

The assembly of the opposed end of support assembly 21 is completed by inserting bladder control frame assembly 35 in direct, overlying, contacting, supporting, engagement with the exposed surface of pad 33. Then, bladder control frame assembly 35 is sealingly enclosed with elongated support pad 33 by mounting shroud 37 between the remaining open edges of cover 34 and flap 40. Once this assembly is completed, support assembly 21 of this present invention is attained and the unitary, fully adjustable, portable, self-contained support assembly of this invention is provided.

Figure 3:
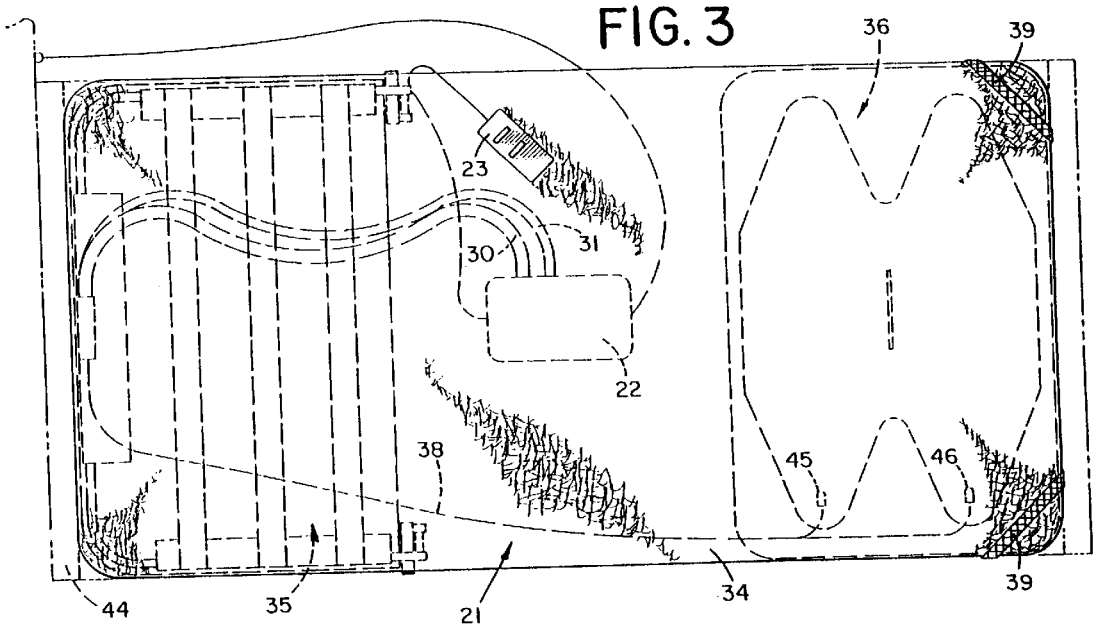
FIG. 3 is a top plan view of the unitary, adjustable, self-contained support assembly of the position controlling system of the present invention positioned on a conventional twin-size bed.
Figure 4:
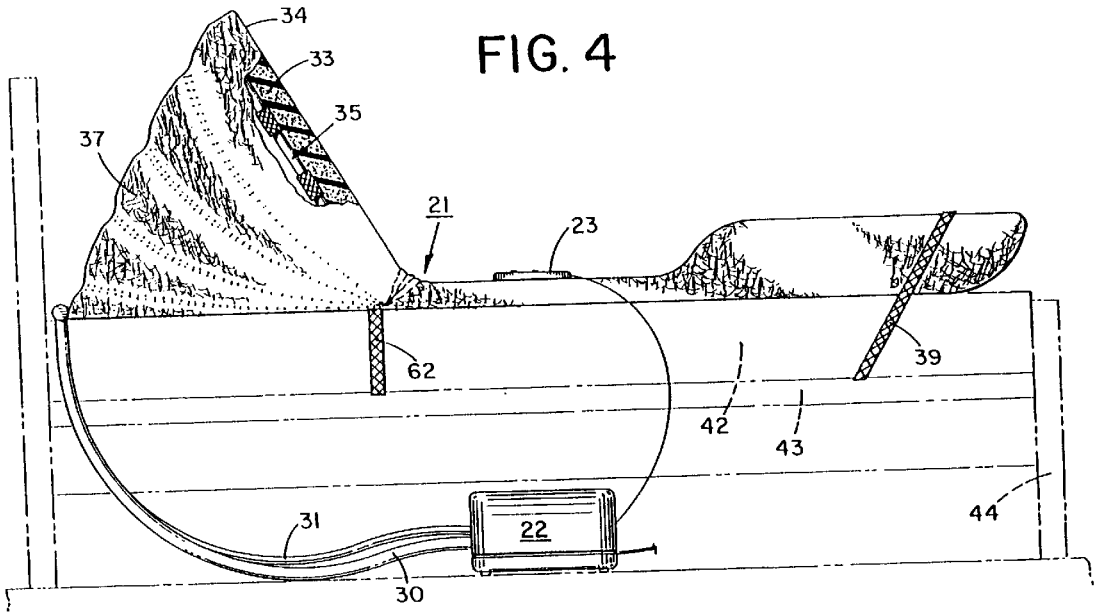
FIG. 4 is a side elevation view, partially in cross-section, of the unitary, self-contained support assembly of FIG. 3.

By employing the construction detailed above, the resulting position controlling system 20 is capable of being easily carried for placement on any desired surface, in order to enable the comfort enhancing qualities provided by position controlling system 20 to be enjoyed anywhere. For purposes of illustration, FIGS. 3 and 4 depict position controlling system 20 mounted on a conventional twin-size bed for enjoyment by a single individual, with the bed shown in phantom as comprising a mattress 42, a box spring 43, and a frame 44.

In using position control system 20 of the present invention, an individual lies down on cover 34, with elongated support pad 33 providing the supporting cushioning for the individual. Of course, when support assembly 21 is positioned on a conventional bed, as shown in FIGS. 4 and 5, further supporting comfort is provided by mattress 42 and box spring 43.

With unitary, adjustable support assembly 21 placed in overlying covering engagement with the top surface of mattress 42, the user merely lies down on covering layer 34 and elongated support pad 33, and grasps control means 23 in order to activate position controlling system 20. If elevation of the back of the user is desired, the appropriate button on control means 23 is pressed, causing air flow control assembly 22 to be activated into forcing air to flow through hose 30. This air flow then causes bladder control frame assembly 35 to be inflated. As bladder control frame assembly 35 is inflated, the entire back supporting portion of pad 33 of support assembly 21 is raised into any desired position, between 0° and 80°.

At any time the desired elevated position is reached, the user merely removes activation pressure from control means 23, causing the air flow to stop. In this way, the user is able to quickly and easily position the back supporting position of pad 33 of support assembly 21 in any desired angular relationship relative to the flat horizontal surface of mattress 42. One such arcuately raised position for support pad 33 of support assembly 21 is shown in FIG. 4.

Whenever the user wishes to return to the horizontal position, the user merely presses the appropriate button on control means 23, which causes bladder control frame assembly 35 to automatically become deflated. In the preferred embodiment of the present invention, as is further detailed below, the air is removed from bladder control frame assembly 35 automatically, without requiring the motor to be activated. It has been found that weight of the user coupled with the elastic forces inherent in the construction of shroud 37 enables bladder control frame assembly 35 to be quickly and efficiently moved from a fully raised position to its horizontal position.

Figure 2:
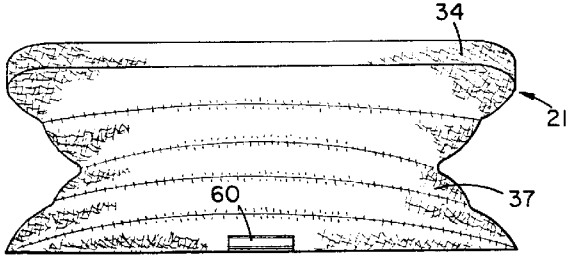
FIG. 2 is a rear elevation view of the unitary, portable, self-contained support assembly of the position controlling system depicted in a partially elevated position.

In addition to assisting and forcing the air out of bladder control frame assembly 35, the elastic biasing means formed in shroud 37 also assure that shroud 37 automatically contracts from its fully extended position, depicted in FIG. 4, to a fully contracted position, wherein shroud 37 is virtually unseen due to its contraction into a compact, integrated, cooperating interengagement with bladder control frame assembly 35. This position is depicted in FIG. 3. In FIG. 2, shroud 37 is depicted partially expanded contracted due to the elastic biasing means formed therein. This position would be realized during the raising or lowering of support assembly 21.

When the lower, leg supporting portion of support assembly 21 is to be elevated, the user presses the appropriate buttons on control means 23 to activate the inflation of panel member 36. As shown in FIGS. 3 and 4, air flow delivery hose 31 extends from air flow control assembly 22 in association with hose 30. Hose 30 is mounted in interengagement with bladder control frame assembly 35, while hose 31 is connected to interior tubing 38, the terminating end of which is positioned with the inlet to bladder control frame assembly 35. Tube means 38 is mounted within cover 34, extending along a surface of support pad 33 to interconnected engagement with inlets 45 and 46 of inflatable panel member 36.

As a result, once an individual activates controller 23 for raising the leg supporting portion of support assembly 21, air flow control assembly 22 is activated, causing air to flow through tube 31 and tube 38 to panel member 36. Upon receipt of this air flow, panel member 36 is inflated, causing pad 33 to be moved away from flap 41. This movement causes the legs of the user to be raised by the supporting surface of pad 33, as depicted in FIG. 4.

In the preferred embodiment, as depicted in FIGS. 3 and 4, strap means 39 are mounted at the opposed comers in association with panel member 36. In the preferred embodiment, a continuous, elastic strap is employed which is wrapped about mattress 42 in order to secure the ends of pad 33 to mattress 42. Of course, if desired, separate fastenable straps can be employed, as opposed to using a continuous strap.

Strap means 39 are preferably employed in order to assure that the ends of pad 33 are prevented from being excessively lifted away from mattress 42 during the inflation of panel member 36. It has been found that by incorporating straps 39 along at least the corners of pad 33, this unwanted lifting is eliminated and a more comfortable, aesthetically pleasing result is achieved.

In order to best understand the overall operation of integrated, portable, position controlling system 20 of the present invention, the details of construction of both bladder control frame assembly 35 and inflatable panel member 36 should be understood. By referring to FIGS. 6–11, along with the following detailed disclosure, the details of construction, and operation of bladder control frame assembly 35 can best be understood.

The principal components of bladder control frame assembly 35 are outer, U-shaped frame member 50, inner U-shaped frame member 51, and bladder 52. In the preferred embodiment, U-shaped frame members 50 and 51 are interconnected to each other at both of their opposed terminating ends by bolt means 53. Preferably, bolt means 53 enable outer U-shaped frame member 50 to be freely pivotable relative to inner frame member 51 about the axis defined by bolt means 53.

In the preferred embodiment, frame members 50 and 51 are constructed and interconnected to possess a nested, interleaved configuration, wherein both frame members 50 and 51 lie in the same plane. This position and configuration is shown in FIGS. 6 and 7.

In addition, a spacer 54 is preferably mounted coaxially with each of the bolt means 53 to maintain U-shaped frame members 50 and 51 at a fixed spaced distance relative to each other. This spaced distance is preferably maintained to be greater than the normal width of an individual's finger or thumb. By assuring this spacing between frame members 50 and 51, accidental pinching or unwanted capture of any individual's fingers should be avoided.

In FIGS. 8–11, the interconnected, mounted, controlled engagement of bladder 52 with frames members 50 and 51 can best be seen. In the preferred construction, bladder 52 comprises an enlarged sealed interior chamber having frame engaging outer surfaces 57 and 58. In order to securely retain and controllably move U-shaped frame members 50 and 51 in the desired arcuate path, frame retaining sleeves 59 are affixed to outer surfaces 57 and 58 of bladder 52. Preferably, three independent frame retaining sleeves 59 are mounted on each frame engaging surface 57 and 58 in order to securely retain each of the separate legs of U-shaped frame members 50 and 51. In this way, smooth, twist-free arcuate movement of frame members 50 and 51 is provided.

The construction of bladder 52 is completed by securely affixing air-delivery conduit 60 to frame engaging surface 57 of bladder 52. In the preferred construction, conduit 60 is sealingly connected at one end thereof to the internal sealed zone of bladder 52, with its opposed end being constructed for ready interconnected engagement with air delivery tube 30. In this way, once the air flows through tube 30, the air is channeled directly into the sealed interior of bladder 52, thereby causing bladder 52 to inflate.

As shown in FIGS. 10 and 11, during the inflation process, bladder 52 will expand causing outer frame member 50 to arcuately pivot relative to inner frame member 51. This arcuate pivoting motion of frame member 50 is caused since inner frame member 51 is positioned directly on the supporting surface such as mattress 42 as shown in FIG. 10. In the preferred embodiment, bladder 52 is constructed to enable outer frame member 50 to pivot through an arc up to a maximum of about 80°. However, as fully discussed above, the inflation of bladder 52 can be halted at any time by the user in order to retain frame member 50 elevated at any position ranging between 0° and 80°. In FIGS. 10 and 11, the fully inflated raised position of outer frame member 50 is shown.

When unitary, adjustable, self-contained support assembly 21 of this invention, with bladder control frame system 35 mounted therein, is used in permanent, overlying covering engagement with mattress 42, it is preferred that strap means 62 are employed. In the preferred construction, elongated strap means 62 are securely affixed to both terminating ends of inner frame member 51 and extend therefrom, with conventional fastening means mounted at the opposed ends of strap means 62, in order to enable the strap means to be securely interconnected with each other. In this way, strap means 62 can be wrapped about mattress 42 to securely hold bladder controlled frame system 35, as well as unitary support assembly 21 within which bladder control frame assembly 35 is affixed, to mattress 42. As a result, the entire unitary support assembly 21 is prevented from sliding on the surface of mattress 42, thereby assuring continuous, long-term, trouble-free mounted interengagement of support assembly 21 with mattress 42.

The construction of bladder controlled frame system 35 is completed by securely affixing a plurality of support straps 65 between opposed, facing legs of U-shaped frame member 50. As clearly shown in FIGS. 8, 10 and 11, the opposed terminating ends of each elongated strap 65 is securely affixed to the opposed facing legs of U-shaped frame member 50, with straps 65 extending in substantially parallel relationship across frame engaging surface 58 of bladder 52. Although straps 65 can be positioned in a plurality of alternate locations, it is preferred that strap receiving zones be cut out from frame retaining sleeves 59 in order to enable straps 65 to be mounted in parallel relationship with each other along the length of frame retaining sleeves 59 of bladder 52.

By securely mounting a plurality of elongated support straps 65 in the manner detailed above, with each of the elongated straps 65 being securely affixed at their opposed ends to maintain each of the straps 65 relatively stiff or taut, any unwanted twisting or skewed movement of frame member 50 relative to frame member 51 during the inflation process or use is avoided. In addition, elongated straps 65 provides a secure, firm substantially movement-free support surface for pad 33 and the user's weight thereon. Furthermore, it has been found that elongated support straps 65 also assure that bladder 52 is inflated in a more efficient manner, and any unwanted ballooning of bladder 52 within U-shaped frame member 50 is prevented by the resistance provided by straps 65.

Figure 24:
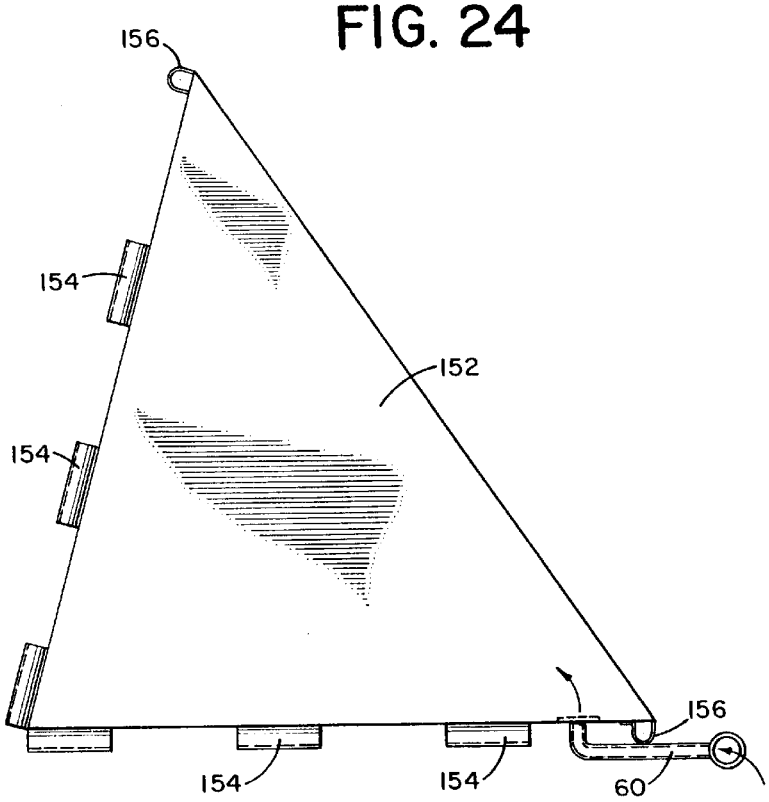
FIG. 24 is a side elevation view of an alternate embodiment of the bladder assembly of the present invention, with the bladder depicted fully inflated.
Figure 25:
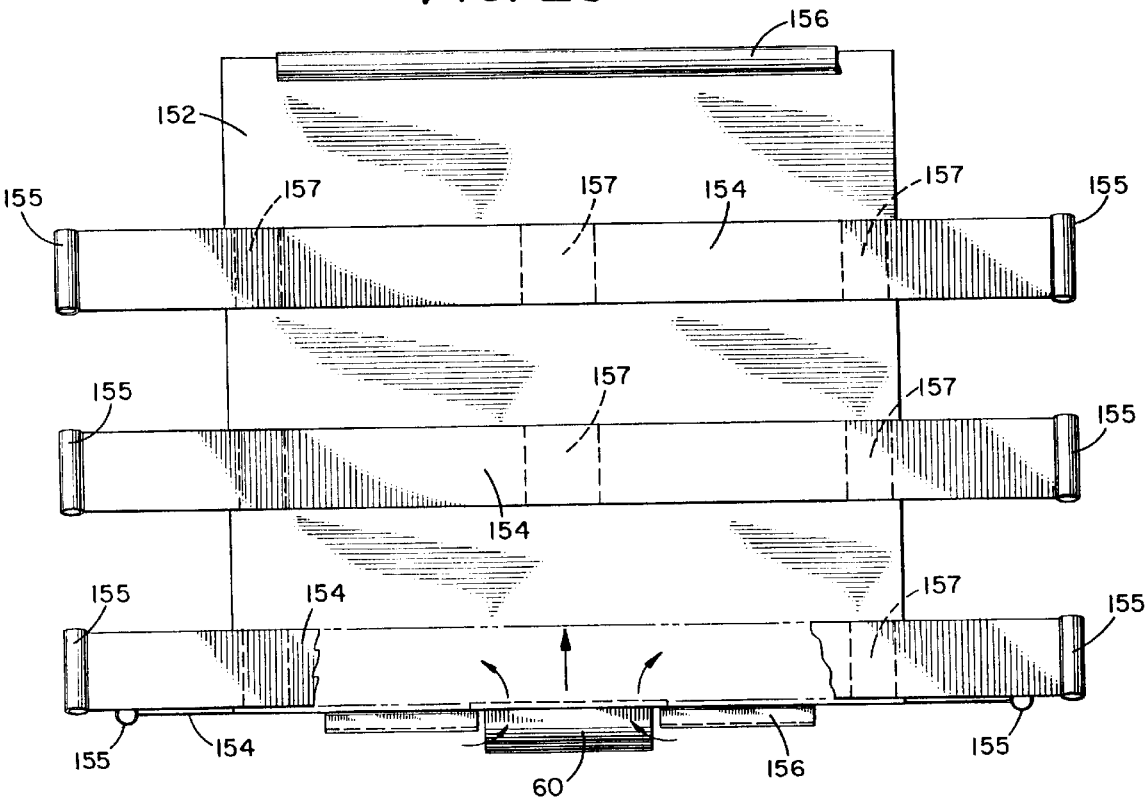
FIG. 25 is a rear view of the bladder assembly of FIG. 24.

In FIGS. 24, and 25, an alternate construction for the inflatable bladder of the present invention is depicted. In this embodiment, bladder 152 comprises an overall size and shape which defines the sealed chamber to be inflated for controlling the movement of U-shaped frame members 50 and 51.

As detailed above in reference to bladder 52, bladder 152 incorporates an air delivery conduit 60 sealingly affixed to one surface of bladder 152. Conduit 60 preferably is sealingly connected at one end thereof to the internal sealed zone of bladder 152 with the opposed end of conduit 60 being positioned for easy interconnected engagement with air delivery tube 30. In this way, once the air flows through tube 30, the air is channeled directly into the sealed interior of bladder 152, causing bladder 152 to inflate.

In order to securely mount bladder 152 to frame members 50 and 51, a plurality of elongated straps 154 are mounted along two adjacent surfaces of bladder 152. In the preferred embodiment, straps 154 are mounted in substantially aligned parallel relationship on the desired surface of bladder 152, with each strap being securely affixed to the bladder surface at a plurality of points along its length thereof, or along its entire length.

In the preferred embodiment, each strap 154 is heat sealed in at least three spaced locations 157 along its length directly to bladder 152. In this way, an integral, mounted engagement of straps 154 to bladder 152 is attained. If desired, any alternate fastening method may be employed to securely mount straps 154 to bladder 152, without departing from the scope of this invention.

As shown in FIG. 25, each elongated strap 154 comprises frame leg holder 155 formed at each terminating end in a substantially open, hollow, cylindrically shaped configuration. In this way, the legs of frame members 50 and 51 are easily inserted and securely retained by holders 155.

In addition, in order to assure the secure mounted interengagement of bladder 152 with frame members 50 and 51, additional frame engaging sleeves 156 are mounted along the terminating edge of the surface of bladder 152 to which straps 154 are securely mounted. In this way, bladder 152 is capable of being securely mounted to both the side legs and intermediate portion of each frame member 50 and 51 in secure, movement controlling engagement to assure the desired arcuate controlled movement thereof.

Figure 32:
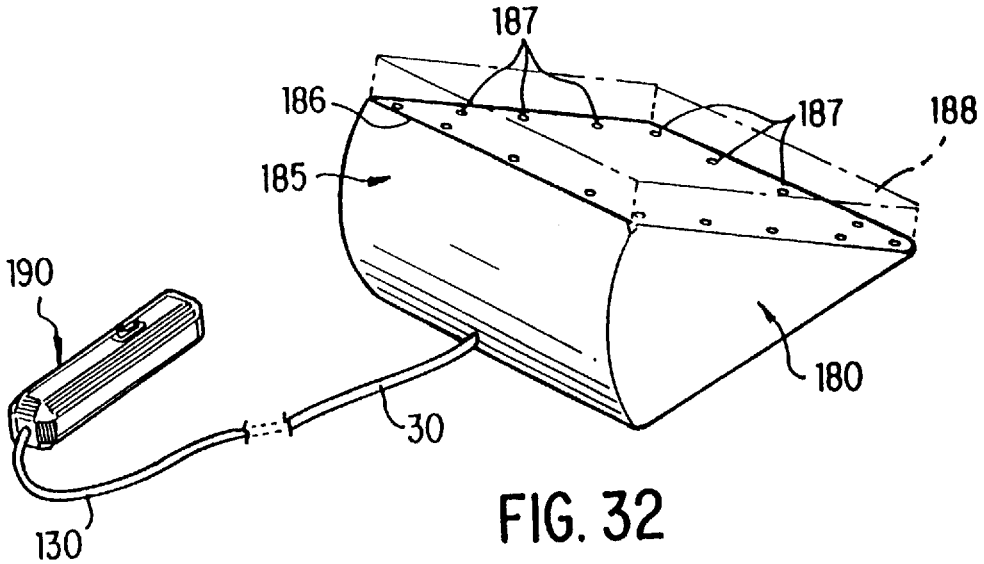
FIG. 32 is perspective view depicting an alternate embodiment of the inflatable bladder assembly of the present invention, depicted as a self-contained support system.

In FIG. 32, a further alternate embodiment of the air inflatable system of the present invention is depicted. In this embodiment, inflatable elevation system 180 is depicted incorporating an inflatable bladder 185 and a hand-holdable air flow control assembly 190, the construction of which is detailed below. Bladder 185 defines the sealed chamber to be inflated and comprises the overall size and shape desired for attaining the particular degree of elevation.

If desired, a frame assembly having the construction detailed above is mounted to the slanted, adjacent interior walls of bladder 185. The incorporation of a front assembly provides additional strength and rigidity to bladder 185, while also providing controlled arcuate movement of the cooperating surfaces of bladder 185. Alternatively, as generally represented in FIG. 32, the top and/or bottom surface of bladder 185 may incorporate a stiffening board 186 to stiffen the surface and prevent unwanted bulging of bladder 185 as bladder 185 is inflated.

In the preferred embodiment, bladder 185 incorporates a plurality of fastening means 187 mounted on stiffening board 186, about its outer peripheral edges. Although the use of fastening means 187 is optional, the incorporation of fastening means is preferred to enable a cushion 188, depicted in phantom, to be mounted to stiffening board 186. Cushion 188 is preferred for providing a softer surface upon which an individual can comfortably rest and be fully supported.

As is apparent from this disclosure, elevation system 180 may be employed separately as a highly portable, universally placeable supporting and position elevating system, which can be used on any desired surface in any desired location. By inflating bladder 185 to a desired level, stiffening board 186 and support cushion 188, if employed, is raised to the desired arcuate distance for lifting the back of an individual and allowing that individual to rest in an elevated, more comfortable location for performing any particular activity.

In this embodiment, the precise arcuate position, as well as the inflation and deflation of bladder 185, is easily achieved by employing air flow control assembly 190. As is fully detailed below, hand-holdable air flow control assembly 190 combines in a single, small, easily held package, both functions of the air flow control assembly and the controller. In this way, an easily employed, readily transportable, elevation system is obtained.

In order to provide a visual pleasing bladder assembly 185 and enhance the aesthetic image presented thereby, inflatable bladder 185 preferably incorporates a decorative outer surface which provides the desired enhanced visual appearance. In this way, a visually pleasing inflatable elevation system 180 is attained in an easily produced, low cost construction. Alternatively, if further visual enhancements are desired, bladder 185 may be peripherally enveloped by a covering or shroud which is constructed from suitable, decorative material to provide a more finished, aesthetically pleasing appearance.

By employing this embodiment of the present invention, inflatable elevation system 180 is easily and conveniently used in a wide variety of situations and locations. Due to its highly transportable construction, elevation system 180 is easily moved to any location desired.

Furthermore, once placed in a desired location, air flow control assembly 190, or air flow control assembly 22 if preferred, is connected to a power source and, once activated, delivers the air flow to bladder 185 for inflating bladder 185 to any desired position. In this way, the surface of bladder 185 may be used directly to provide the desired, elevated support in a low cost, easily manufactured, and easily useable system.

In further alternate applications of elevation system 180, elevation system 180 may be employed in combination with an elongated support pad or cushion 33, which is preferably peripherally surrounded and enveloped by a cover 34, as defined above. By employing optional fastening means 187, elevation system 180 can be quickly and easily secured to cushion 33 and cover 34, by the fastening means, to attain an integrated, portable, position controlling system, as detailed above.

Figure 12:
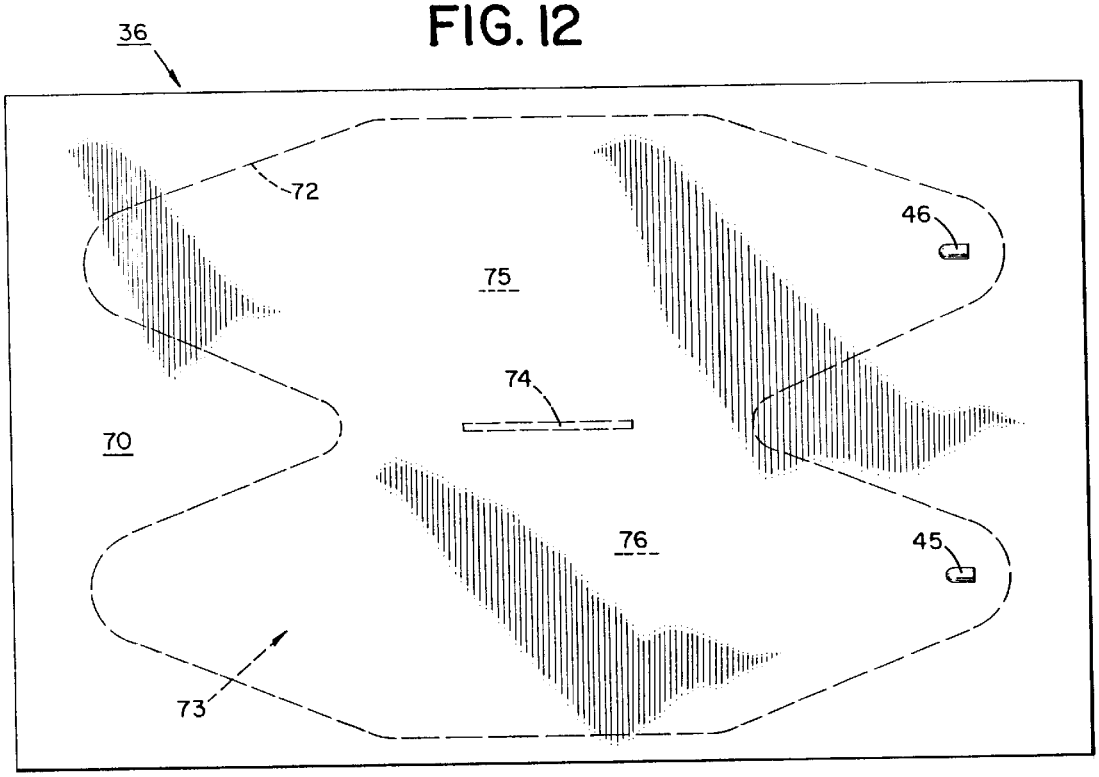
FIG. 12 is a top plan view of the inflatable panel member incorporated into the unitary, adjustable, portable, self-contained support assembly of the present invention.
Figure 13:
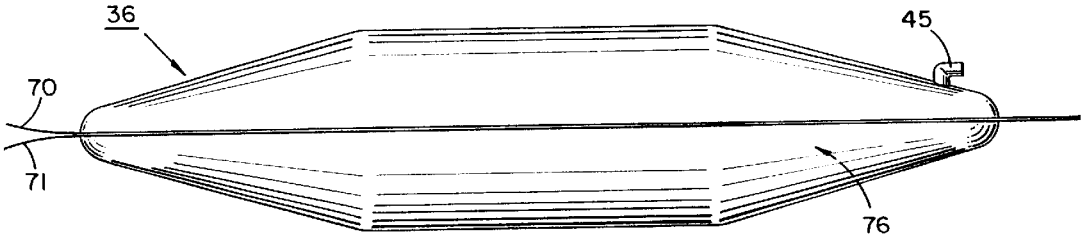
FIG. 13 is a front elevation view of the inflatable panel member of FIG. 12 depicted in a fully inflated configuration.
Figure 14:
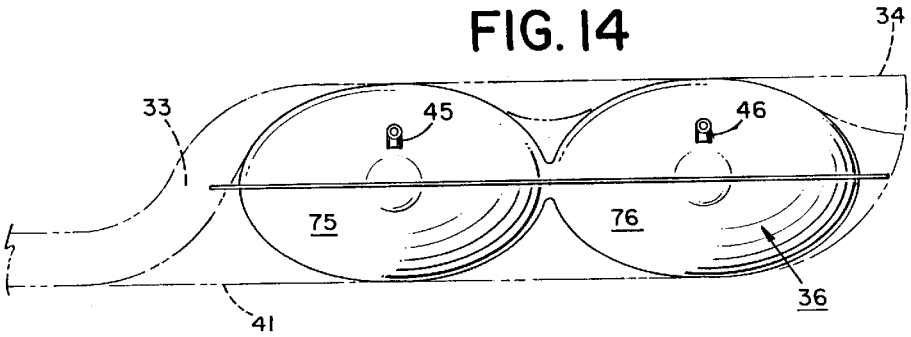
FIG. 14 is a side elevation view of the fully inflated panel member depicted in FIG. 13.

By referring to FIGS. 12, 13 and 14, along with the following detailed disclosure, the construction and operation of inflatable panel member 36 can best be understood. In the preferred embodiment, panel member 36 comprises two substantially identically shaped layers 70 and 71 of air impervious material which are placed in overlying, contacting engagement with each other. In addition, layers 70 and 71 are heat sealed to each other, along sealing line 72, in order to form an internal air impervious zone 73 between layers 70 and 71. In addition, inlets 45 and 46 are mounted to layer 70 within heat seal line 72, thereby providing an air inlet for inflating the air retaining interior zone 73 formed between layers 70 and 71.

In the preferred embodiment, the interior air retaining zone 73 is formed as two substantially equal sized, generally oval shaped chambers which are interconnected along one surface thereof. In the preferred embodiment, an interior partition 74 is placed between layers 70 and 71 and sealed therebetween, in order to define interior generally oval chambers 75 and 76 and assure the controlled inflation thereof.

In the preferred embodiment, as clearly depicted in FIG. 12, each of the chambers 75 and 76 is formed with each opposed end thereof having a shape, when uninflated, that substantially defines an equilateral triangle with the apex thereof comprising a smoothly rounded and blended curve, which converges with the sides thereof. As shown in FIG. 13, when inflated, each chamber 75 and 76 comprises a shape at each of its ends which forms a cone connected at its base to a centrally disposed cylindrical shape, with the cone terminating with a smoothly rounded apex.

This particular shape has been found to be particularly important in assuring the filling of chambers 75 and 76 in a manner which assures maximum inflation in the central portion of chambers 75 and 76 in order to attain the desired result. By employing this construction, inflatable panel member 36 achieves the fully inflated configuration depicted in FIG. 13, with the principal inflation zone being centrally disposed along inflatable panel member 36, with the sides thereof providing a smooth, narrowing tapered configuration.

In FIG. 14, inflatable panel member 36 is depicted fully inflated with support pad 33 and cover layer 34 shown in phantom. As is evident from FIG. 14, the full inflation of panel member 36 causes chambers 75 and 76 to become fully enlarged which simultaneously causes support pad 33 to be moved out of engagement with flap 41 of cover 34. As a result, cover 34 and pad 33 are moved upwardly, away from flap 41 which is in contact with the surface on which support member 21 has been placed.

Typically, the legs of the user are resting on pad 33 and cover 34 in the area overlying panel member 36. As a result, the inflation of panel member 36 causes the legs of the user to be raised, enhancing the comfort of the user by lifting the legs to any desired position between completely horizontal and the fully inflated position depicted in FIG. 14.

In FIGS. 28, 29, 30 and 31, alternate constructions for attaining the integrated, portable, position controlling system 20 of the present invention are shown. In these drawings, alternate constructions are detailed for securely mounting the bladder controlled frame with unitary, self-contained, fully adjustable, portable support assembly 21 or for achieving a fully integrated mattress assembly. By referring to FIGS. 2–5, and its associated disclosure, along with the following detailed disclosure, the similarities and variations of these additional embodiments can best be understood.

Figure 28:
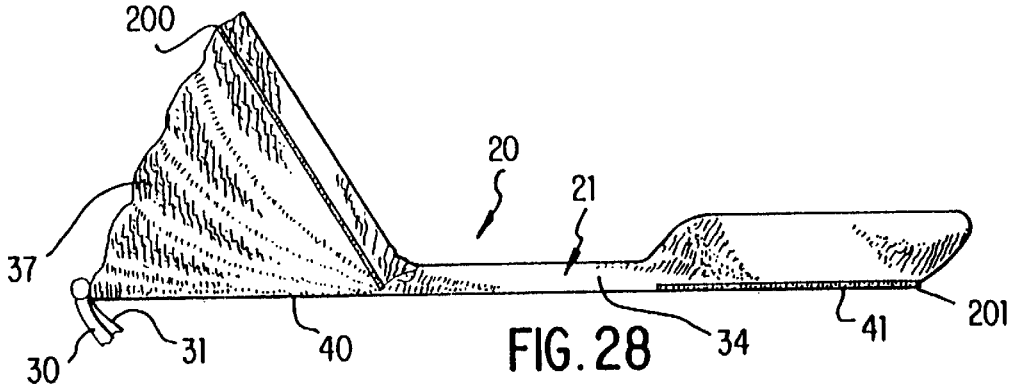
FIG. 28 is a side elevation view of an alternate embodiment of the unitary, self-contained, adjustable support assembly of the present invention.

In FIG. 28, unitary, self-contained, fully adjustable support assembly 21 is constructed in a manner similar to the constructions detailed above. In this embodiment, in order to improve the ease of construction of support assembly 21, zippers 200 and 201 are mounted about the ends of support assembly 21.

In the preferred construction of this embodiment, zipper 200 peripherally surrounds the end of support assembly 21 within which bladder control frame assembly 35 is mounted. In addition, zipper 201 is preferably mounted to the opposed end of support assembly 21, peripherally surrounding the portions there of in which panel member 36 is mounted.

In the preferred construction, one portion of zipper 200 is affixed directly to the side edge of cover 34 which peripherally surrounds the portion of pad 33 mounted in contact with bladder control frame assembly 35. The other portion of zipper 200 is mounted to shroud 37 in order to enable shroud 37 to be rapidly affixed to cover 34 and pad 33 contained therein. Furthermore, in this embodiment, opposed edge of shroud 37 is mounted directly to flap 40 of cover 34.

By employing this construction, bladder control frame assembly 35 is quickly and easily mounted in association with pad 33 and cover 34 in order to form support assembly 21. In addition, access to bladder control frame assembly 35 is easily attained merely opening zipper 200. As a result, both ease of assembly and ease of repair are realized.

In addition to incorporating zipper 200 with cover 34 at the upper end of support assembly 21, this embodiment also incorporates a zipper 201 mounted at the opposed end of cover 34 between the side edge of cover 34 and flap 41. By incorporating zipper 201 peripherally surrounding the lower portion of cover 34 and peripherally enclosing pad 33 therein, panel member 36 is easily installed in the precisely desired position. In addition, if access to panel member 36 is required for any purpose after installation, such access is easily realized using zipper 201.

Figure 29:
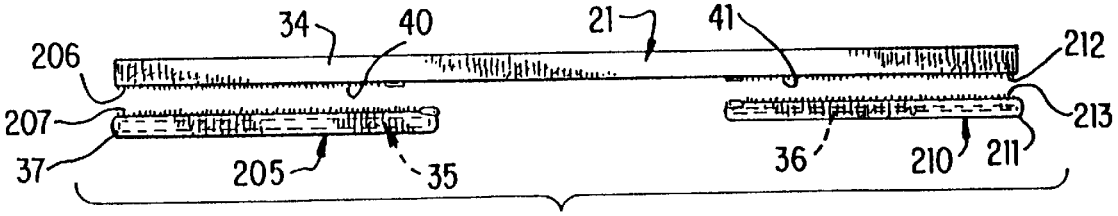
FIG. 29 is a side elevation view depicting a further alternate embodiment of the unitary, self-contained, adjustable support assembly of the present invention.
Figure 30:
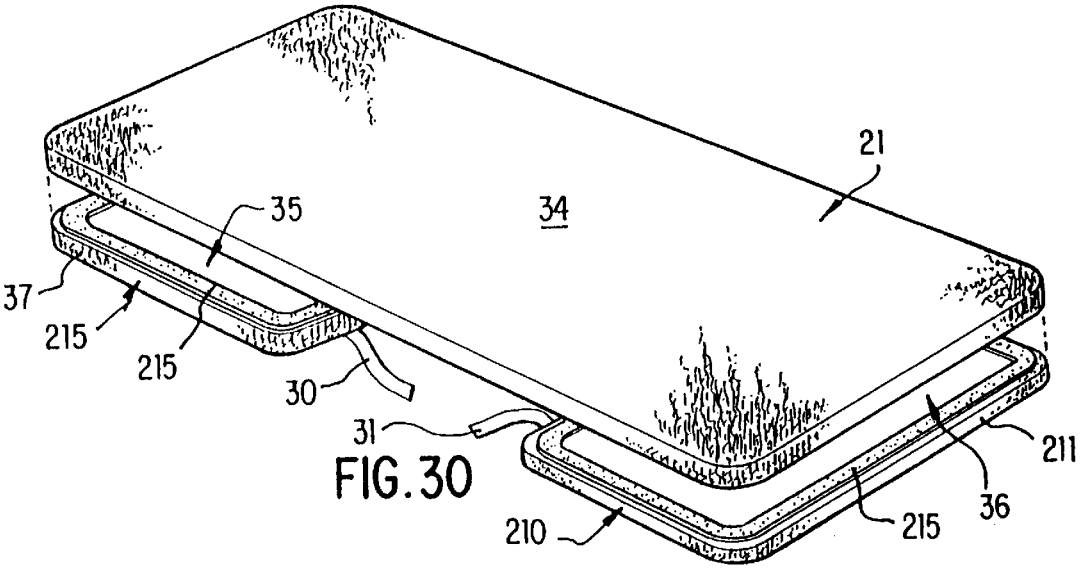
FIG. 30 is a perspective view, depicting a still further alternate embodiment of the unitary, adjustable, self-contained support assembly of the present invention.

In FIGS. 29 and 30, a further alternate embodiment is depicted. In this embodiment, support assembly 21 is constructed with pad 33 peripherally surrounding and enclosed by cover 34. In addition, flaps 40 and 41 are stitched directly to the side edge of cover portion 34 to peripherally surround and enclose pad 33 therein.

In order to provide the enhanced benefit attained by this embodiment of the present invention, a separate elevation control assembly 205 is employed. In this preferred construction, elevation control assembly 205 incorporates a fully assembly bladder control frame assembly 35 which is peripherally surrounded and enclosed within shroud member 37. As with the embodiments detailed above, and discussed in reference to FIGS. 2–4, air delivery hose 30 is interengaged with bladder control frame assembly 35 to provide the desired air flow required for its operation. In addition, the opposed end of air delivery hose 30 is connected to an air delivery control assembly (not shown).

In the embodiments depicted in FIGS. 29 and 30, elevation control assembly 205 is completed by mounting fastening means about the terminating edge of shroud member 37 in order to enable elevation control assembly 205 to be quickly and easily securely affixed to cover 34 and pad 33 contained therein. By constructing a separate and independent elevation control assembly 205 within which bladder control frame assembly 35 is securely mounted, the final assembly and servicing of bladder control frame assembly 35 is substantially enhanced.

In order to complete the assembly of unitary, self-contained, fully adjustable, portable support assembly 21, elevation control assembly 205 is affixed to cover 34 by employing the cooperating fastening means mounted to cover 34 and control assembly 205. In this way, secure mounted inter-engagement of elevation control assembly 205 with cover 34 and pad 33 is attained and a fully assembled, easily employed, portable support assembly 21 is realized in a cost efficient construction.

In the preferred construction of this alternate embodiment, portable support assembly 21 also incorporates a separate and independent leg lift control assembly 210. Leg lift control assembly 210 incorporates inflatable panel member 36 which is peripherally surrounded and enclosed, substantially in its entirety, with a covering 211.

The construction of leg lift control assembly 210 is completed by mounting fastening means about the outer peripheral edge of covering 211, with the fasteners selected for cooperative engagement with fastening means mounted to the lower end of cover 34. In this way, leg lift control assembly 210 is easily constructed as a separate unit and rapidly affixed to cover 34 in order to complete the construction of support assembly 21.

In the embodiment shown in FIG. 29, the fastening means employed is a zipper, and cover 34 of portable support assembly 21 is shown incorporating zipper portion 206 peripherally surrounding the upper end of cover 34 and pad 33, and zipper portion 212 peripherally surrounding the lower end of cover 34 and pad 33. In addition, a cooperating, interengaging zipper portion 207 is mounted to control assembly 205, peripherally surrounding bladder control frame assembly 35 on three sides thereof. In addition, zipper portion 213 is attached to covering 211 of leg lift control assembly 210, peripherally surrounding the outer edge of covering 211, encircling panel member 36 on three sides thereof.

In this way, both control assembly 205 and leg lift control assembly 210 are able to be constructed independently and quickly and easily affixed to covering 34 of portable support assembly 21 by merely affixing the cooperating zipper portions to each other. As a result, assembly ease is realized, as well as rapid access to frame assembly 35 and panel member 36 whenever desired.

In the embodiment depicted in FIG. 30, alternate fastening means are depicted. In this embodiment, elevation control assembly 205 and leg lift control assembly 210 incorporate hook/loop fasteners 215 peripherally surrounding each control assembly for mating interengagement with cooperating hook/loop fasteners mounted to cover 34 of portable support assembly 21.

As is apparent to one of ordinary skill in the art, zipper fasteners and hook and loop fasteners are merely examples of alternate fastening systems that can be employed, without departing from the scope of the present invention. Clearly, any fastening system desired can be used with equal efficacy to securely affix elevation control assembly 205 and leg lift control assembly 210 to cover 34 in order to form the desired portable support assembly 21. Consequently, the incorporation and use of any fastening system is considered to be within the scope of the present invention.

By employing the constructions shown in FIGS. 29 and 30, rapid assembly of portable, support assembly 21 is realized, reducing production costs as well as the retail price. Furthermore, if any system failure is realized in either bladder control frame assembly 35 or panel member 36, these components can be quickly and easily accessed, by merely opening the fastening means in order to gain access to the desired area.

Furthermore, cleaning or laundering of cover 34 is easily attained, if necessary, completely eliminating any possibility that damage may be caused to bladder control frame assembly 35 or panel member 36. If cleaning is desired, elevation control assembly 205 and leg lift control assembly 210 are completely removed from cover 34, thereby enabling cover 34 to be easily cleaned without causing any harm to the mechanical air inflatable components of portable support assembly 21.

Figure 31:
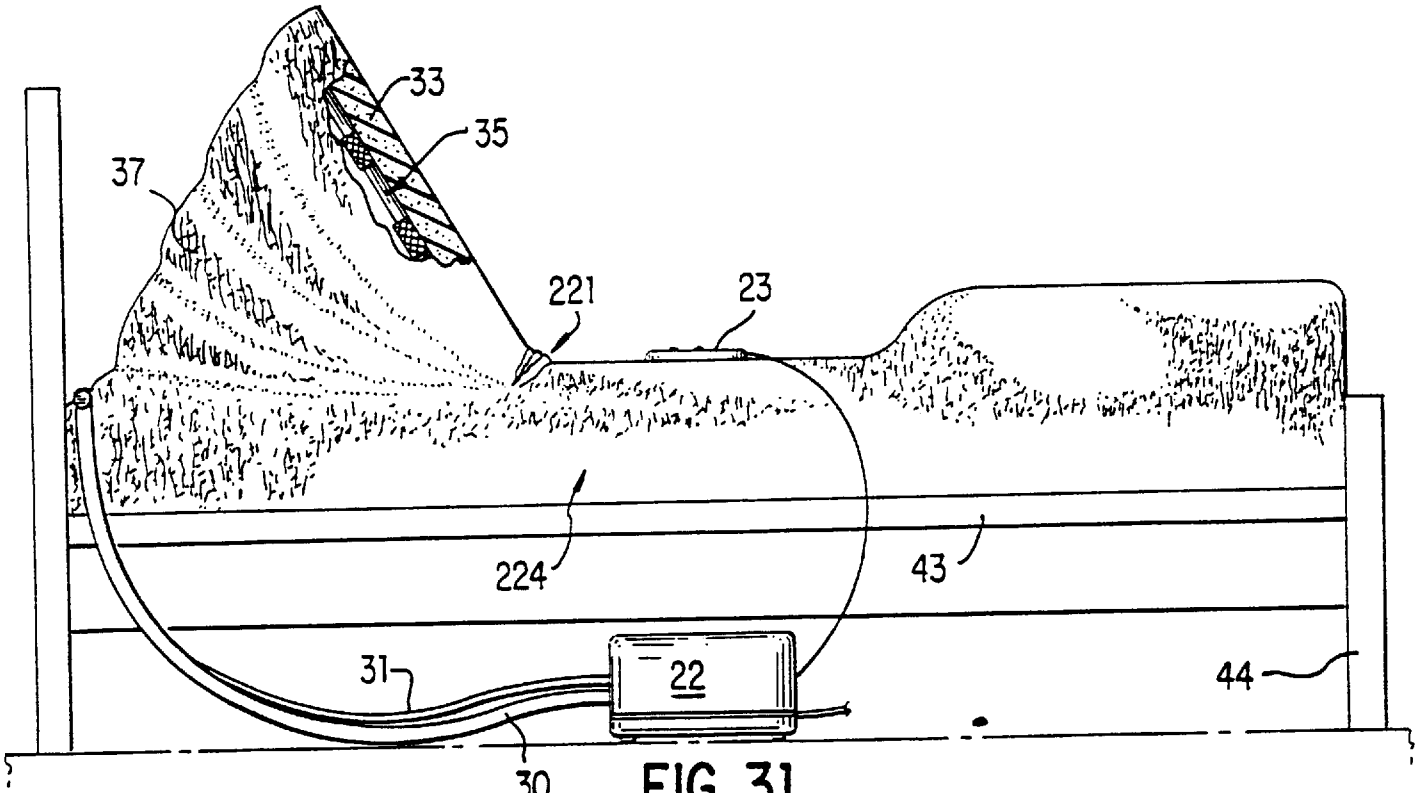
FIG. 31 is a side elevation view, partially in cross-section, of another alternate embodiment of the unitary, self-contained support assembly of the present invention.

In FIG. 31, a further alternate embodiment of the present invention is depicted. In this embodiment, the entire support assembly is integrated into a conventional mattress to form a fully adjustable, unitary, self-contained supporting mattress construction 221. In the embodiment depicted, cover 224 peripherally surrounds and encloses pad 33, bladder control frame assembly 35, and panel member 36. These components are positioned on a generally conventional mattress to form integrated, adjustable support assembly 221.

Cover 224 preferably incorporates a shroud 37, integrally formed therewith, in order to provide the added material to enable the integrated support assembly to operate. In the embodiment depicted, integrated, unitary, self-contained mattress support construction 221 is mounted on a supporting frame 43 and bed post 44.

As is evident from the construction depicted in FIG. 31, a fully integrated mattress/support structure is attained. However, this alternate embodiment is not limited to mattress constructions and can be equally effective in other support systems, such as water beds, sleep sofas, couches, etc. Consequently, the embodiment depicted in FIG. 31 is presented for exemplary purposes, and is not intended to limit the present invention to the particular embodiment depicted.

Figure 38:
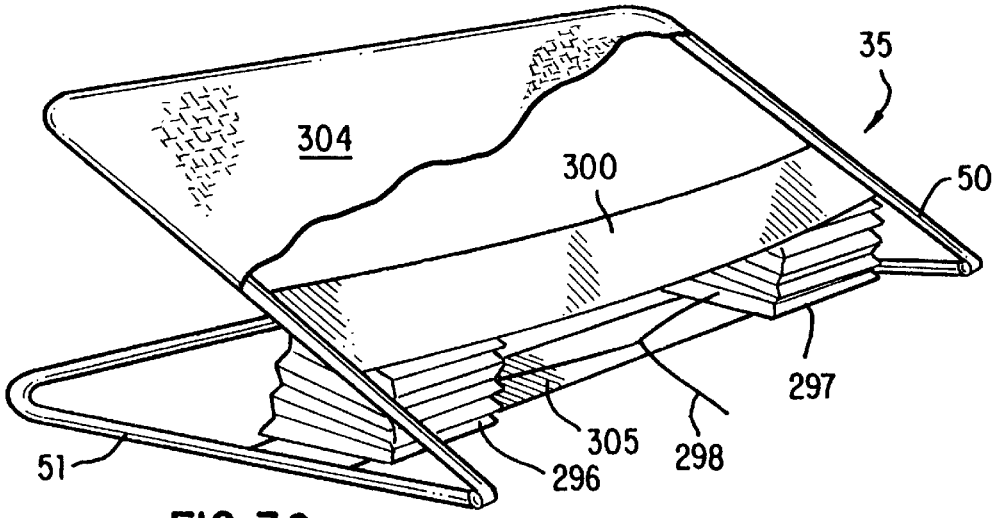
FIG. 38 is a perspective view, partially broken away, of a still further alternate embodiment of the portable, self-contained, unitary movably adjustable support assembly of the present invention.
Figure 39:
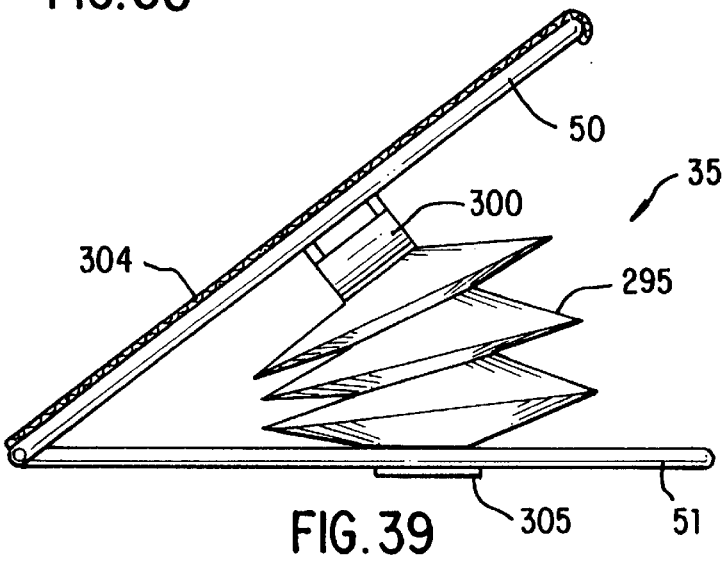
FIG. 39 is a side elevation view of a further embodiment of the portable, self-contained, unitary, movably adjustable support assembly of the present invention.
Figure 40:
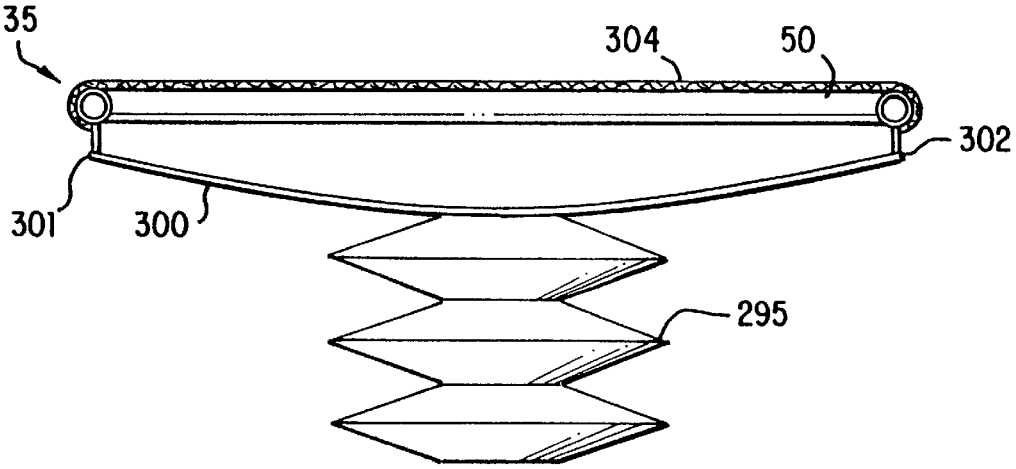
FIG. 40 is an end elevation view of the movably adjustable support assembly of the FIG. 39.

In FIGS. 38, 39, and 40, two further alternate embodiments for bladder control frame assembly 35 are depicted. In these two further alternate embodiments, both a single bladder and a dual bladder construction are fully detailed along with an automatic tension controlling support member. As detailed herein, these alternate constructions provide added comfort and ease of operation for bladder control frame assembly 35 of this invention.

As shown in FIGS. 38–40, as well as detailed above, bladder control frame assembly 35 incorporates an outer U-shaped frame member 50 interconnected with inner U-shaped frame member 51. In the embodiment depicted in FIGS. 39 and 40, a single bladder 295 is employed to controllably move U-shaped frame member 50 relative to frame member 51. In the embodiment depicted in FIG. 38, a dual bladder construction is employed which comprises cooperating bladder members 296 and 297. In both embodiments, plate 305 is mounted to frame member 51 to provide a support for the bladder associated therewith.

In these embodiments, bladder control frame assembly 35 incorporates an elongated, automatic tensioning cross member 300 extending between the juxtaposed, spaced, parallel portions of U-shaped frame member 50. As best seen in FIGS. 39 and 40, cross member 300 comprises an elongated, substantially flat panel having terminating ends 301 and 302. As depicted in the drawings, terminating ends 301 and 302 are affixed to the juxtaposed, spaced portions of frame member 50 either directly or using a suitable bracket member.

In addition, cross member 300 comprises an overall length which is greater than the spaced distance between the portions of U-shaped frame member 50 to which ends 301 and 302 of cross member 300 are affixed. As a result, cross member 300 comprises a curved, bowed concave shape relative to frame member 50.

In order to complete the construction of this embodiment of bladder control frame assembly 35, support means 304 is affixed to U-shaped frame member 50 in a manner substantially covering frame member 50 in its entirety. In the preferred embodiment, support means 304 peripherally surrounds and is securely affixed to each portion forming U-shaped frame member 50. Although any desired material can be employed for support means 304, the preferred construction incorporates a thin panel formed from woven or non-woven material, such as textiles, fabric, or plastic sheets.

By employing this construction for bladder control frame assembly 35, a self-adjusting, secure, fully supported frame assembly is realized capable of achieving complete support of the user throughout the arcuate movement of frame member 50 relative to frame member 51. In both embodiments shown in FIGS. 38–40, the inflation of the bladder causes frame member 50 to pivot relative to frame member 51. With an individual resting on frame member 50, the user is fully supported by support means 304.

In order to provide full and complete support to all individuals regardless of the weight of the particular individual using bladder control frame assembly 35, the construction depicted in FIGS. 38–40 provides further enhanced operation of the present invention. In this regard, support means 304 is securely affixed to frame member 50, as detailed above, in order to provide complete support to the user.

If an individual is particularly heavy, which would normally cause support means 304 to be moved concavely inwardly toward the bladders, particularly during the lifting operation, any normal cross member would cause discomfort to the user. However, the incorporation of bowed cross member 300 eliminates all discomfort and provides secure, complete support for all individuals.

By employing this construction, whenever added weight is imposed upon support means 304, the secure affixation of support means 304 to U-shaped frame member 50, in its substantial entirety, draws the U-shaped frame member towards itself. However, cross member 300 prevents any movement of the portions forming U-shaped frame member to move towards each other and, in fact, causes the frame members to move away from each other as bladder 295 or bladders 296 and 297 are inflated.

In those situations where a single bladder is employed, as depicted in FIGS. 39 and 40, the lifting force imposed by inflating bladder 295 acts substantially midway along the length of cross member. As a result, any forces placed upon frame member 50 by support means 304 are fully counteracted by the lifting force imposed by bladder 295 acting on cross member 300, as the force imposed thereby attempts to move support means 304 outwardly, expanding U-shaped frame member 50. Since frame member 50 is incapable of moving outwardly, due to the secure affixation of support means 304 to frame member 50, support means 304 is placed in greater tension by the action of cross member 300. As a result, cross member 304 becomes tighter, assuring greater support and comfort to the user.

Similarly, in the use of dual bladders 296 and 297, a similar outward movement is imposed upon cross member 300, also causing support means 304 to become more taut during the lifting operation. In this way, the user remains in complete comfort without having support means 304 flexing inwardly into contact with cross member 300. As a result, the user is assured of complete comfort and ease of use of bladder control frame assembly 35, regardless of the weight of the individual or the position of frame assembly 35.

In some instances, it has been found that the use of centrally positioned bladder 295 enables frame member 50 to incur arcuate flexing along the portions forming U-shaped frame member 50, particularly when an individual is not positioned substantially centrally on frame member 50 and support means 304, or whatever other support means are employed. In order to prevent any unwanted flexing of frame member 50, the dual bladder system depicted in FIG. 38 may be employed.

In this embodiment, bladder control frame assembly 35 is constructed substantially identical to the structure detailed above, except for employing cooperating bladders 296 and 297 affixed to cross member 300 and support plate 305. Cooperating bladders 296 and 297 positioned directly adjacent cooperating portions of frame members 50 and 51. In order to provide bladders 296 and 297 with simultaneous air flow to assure their simultaneous inflation, a Y-shaped tube member 298 is employed, which provides air flow to both bladders 296 and 297 in a substantially identical manner. As a result, the desired arcuate movement of this embodiment for bladder control frame assembly 35 is achieved. In addition, any arcuate pivoting movement of frame member 50 is completely eliminated by the simultaneous inflation of cooperating bladders 296 and 297 at locations directly adjacent the side portions of U-shaped frame member 50.

In FIGS. 41–45, a further alternate embodiment of the present invention is fully detailed. In this embodiment, a position control system is provided which achieves the back lifting and leg lifting functions detailed above in the previous embodiments. However, in addition to providing these features, this embodiment of the present invention also addresses another problem which has plagued the industry.

In individuals who are either handicapped, or bedridden for extended periods of time, a problem is often encountered with bed sores being developed by such individuals. Consequently, these individuals need to be manually turned into alternate positions in order to avoid unwanted development of such bed sores. In the present invention, a fully controlled, adjustable system is attained which enables users to automatically raise an entire portion of the support system to any desired height in order to assist in the repositioning or turning a patient requiring such attention.

As detailed in FIGS. 41–45, this embodiment of the present invention comprises a support system 308 which incorporates an upper support member 309. In this embodiment, upper support member 309 comprises a plurality of separate and independent panel segments 310, 311, 312, 313, 314, 315, 316, 317, 318, 319, 320, and 321. Although alternate constructions with alternate number of panel segments can be employed, the preferred embodiment of this invention comprises twelve separate and independent panel segments 310–321, all interconnected with each other.

Each of the panel segments 310–321 are positioned in juxtaposed, spaced, edge-to-edge, cooperating relationship with each other, forming the substantially rectangular shaped upper support member 309. In order to provide the user with comfort and ease of use, a support pad, as detailed above in the alternate embodiments, is placed on upper support member 309.

In the preferred construction of this embodiment of the present invention, each panel segment is secured to and cooperatively associated with each adjacent panel segment by a separate and independent hinge member. By employing this construction, panel segment 310 is cooperatively associated and pivotally interconnected with panel segment 311 by hinge member 325. In addition, panel segment 310 is cooperatively associated and interconnected with panel segment 313 by hinge member 326. Similarly, panel segment 311 is cooperatively associated and pivotally interconnected with panel segments 313 by hinge member 327, while also being pivotally interconnected to panel member 314 by hinge member 328.

Similarly, panel segment 312 is pivotally interconnected with panel segment 315 by hinge member 329, while panel segment 313 is pivotally mounted to panel segment 314 by hinge member 330, and panel segment 314 is pivotally mounted to panel segment 315 by hinge member 331. Completing the construction of upper support member 309 of this embodiment of the present invention, hinge member 332 interconnects panel segment 313 with panel segment 316, while hinge member 333 interconnects panel segment 314 with panel segment 317. In addition, hinge member 334 interconnects panel segment 315 with panel segment 318, while hinge member 335 interconnects panel segment 316 to 317 with hinge member 336 interconnecting panel segment 317 to panel segment 318. Similarly, hinge member 337 interconnects panel segment 316 to panel segment 319 with hinge member 338 interconnecting panel segment 317 to panel segment 320, and hinge member 339 interconnecting panel segment 318 to panel segment 332. Finally, hinge member 340 interconnects panel segment 319 to panel segment 320, while hinge member 341 interconnects panel segment 320 to panel segment 321.

Figure 42:
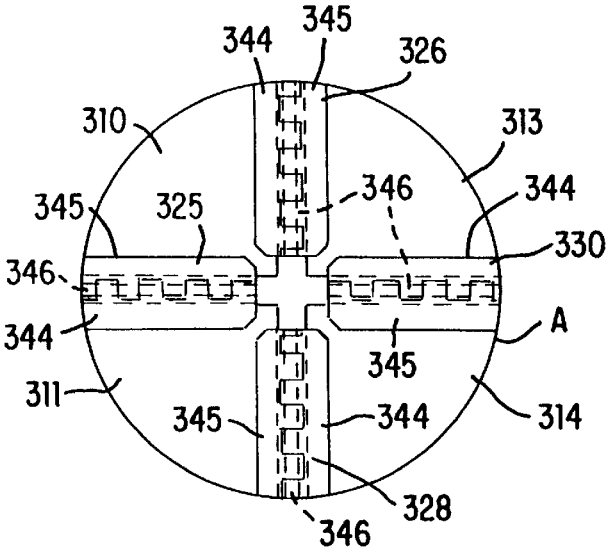
FIG. 42 is an enlarged view of detail "A" of FIG. 41.

By referring to FIG. 2, a detailed, greatly enlarged view of the intersection of panel segments 310, 311, 313, and 314 is depicted. As shown therein, each of these panel segments are mounted to each other by separate and independent hinge members 325, 326, 330, and 328. As shown in FIG. 42, each hinge member 325, 326, 328, and 330 comprise separate and interlocking plates 344 and 345 which are capable of arcuate, pivoting movement relative to each other due to pivot pin 346 maintaining plates 344 and 345 in interlocked engagement, enabling the arcuate pivoting motion thereof. In addition, each of the other panel segments and hinge members are constructed in a substantially identical manner.

Figure 41:
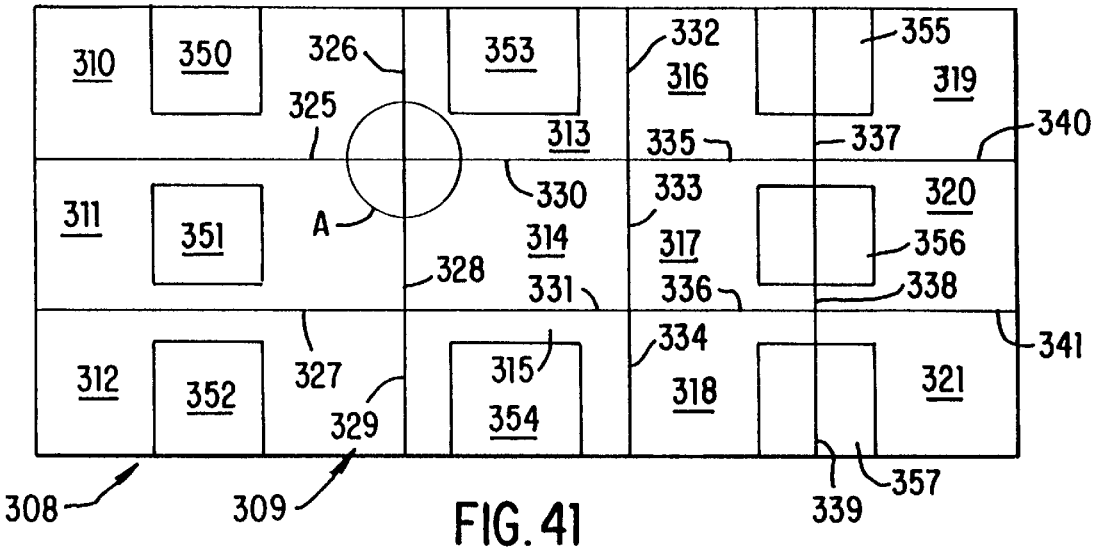
FIG. 41 is a top plan view of a still further alternate embodiment of the support assembly system of the present invention which provides arcuate pivoting motion in a plurality of alternate axial directions.

In order to provide the desired, controlled, arcuate movement of particular desired panel segments 310–321, in a precisely desired manner, support system 308 also incorporates separate and independent air inflatable bladders 350, 351, 352, 353, 354, 355, 356, and 357. As shown in FIG. 41, and further detailed below, air inflatable bladder 350 is cooperatively associated with panel segment 310, while bladder 351 is associated with panel segment 311, bladder member 352 is associated with panel segment 312, bladder member 353 associated with panel segment 313, bladder member 354 associated with panel segment 315, bladder member 355 associated with panel segments 316, and 319, bladder member 352 associated with panel segments 317 and 320, and bladder member 357 associated with panel segments 318 and 321.

As is more fully detailed below, by employing this plurality of bladder members in the particular arrangement detailed herein, complete movement and control over support system 308 is attained. However, if desired, fewer bladder members can be employed without departing from the scope of this invention. In this regard, bladder members 351, 353, 354, and 356 may be selectively or entirely eliminated without departing from the scope of the present invention. However, by employing bladder members 350–357, more complete control and precise movement of upper support member 309 is attained and, as a result, is preferred.

Figure 43:
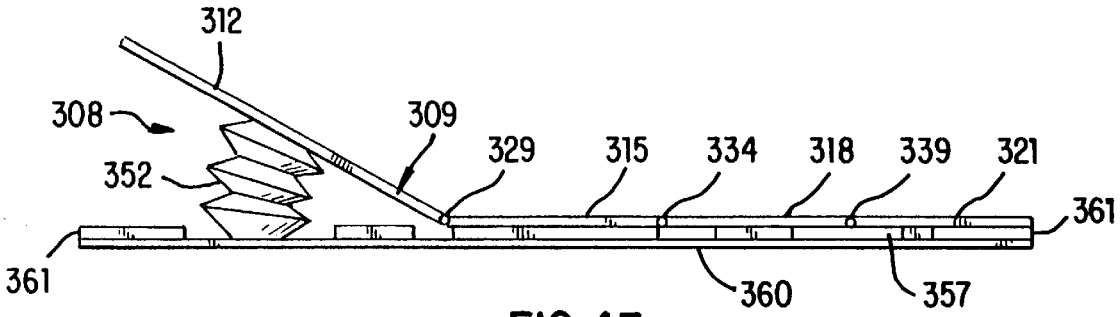
FIG. 43 is a side elevation view of the movably adjustable support assembly system of FIG. 41 shown in one alternate position.
Figure 44:
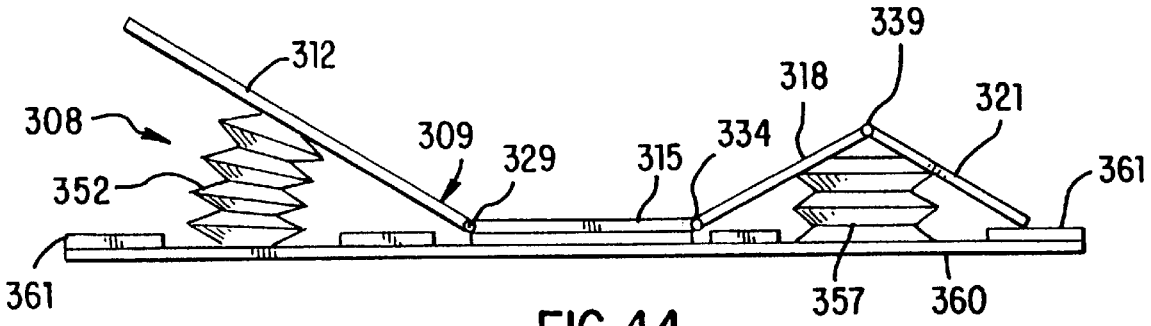
FIG. 44 is a side elevation view of the movably adjustable support assembly of FIG. 41 shown in a further alternate position.
Figure 45:
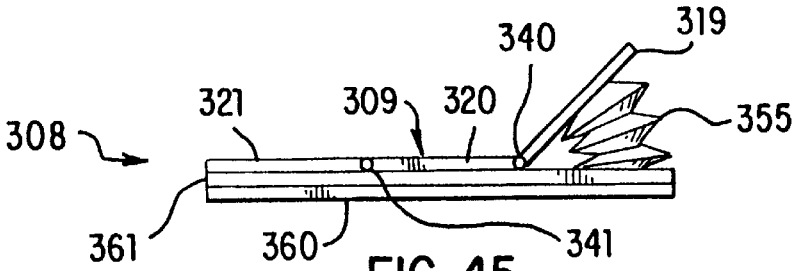
FIG. 45 is an end elevation view of the movably adjustable support assembly system of FIG. 41 shown in a still further alternate arcuately pivoted position.

As shown in FIGS. 43–45, the construction of support system 308 is completed by also incorporating a bottom panel member 360 which comprises a size and shape substantially equivalent to upper support member 309. In addition, in the preferred construction, side panels 361 are preferably employed and mounted to bottom panel 360 in order to obscure the internal construction of support system 308. Although side panels 361 as well as bottom panel member 360 may be eliminated in favor of alternate constructions, the construction depicted in FIGS. 43–45 is preferred.

By employing this embodiment of the present invention, any desired elevation of support system 308 can be attained in order to raise either the back or legs of an individual lying on upper support member 309 or any pad member placed thereon. Whenever raising of the torso of the individual is desired, bladders 350, 351, and 352 are inflated, causing bladder members 350, 352 to expand, simultaneously causing panel segments 310, 311, and 312 to arcuately pivot relative to adjacent panel segments 313, 314, and 315. The arcuate movement of panel segments 310–312 is attained due to the interconnection of these panel segments to the adjacent panel segments by hinge means 326, 328, and 329.

It has been found that once panel segments 310, 311, 312 are raised in initiating this arcuate movement, as depicted in FIG. 43, any arcuate movement of panel segment 310 relative to panel segment 311 or panel segment 312 relative to panel segment 311 is prevented. Furthermore, any such unwanted independent movement is further eliminated by incorporating bladder 351. However, if desired, bladder 351 can be eliminated without adversely affecting the back lifting operation of upper support member 309.

Similarly, whenever the leg raising movement of upper support member 309, is desired, bladders 355, 356, and 357 are simultaneously inflated, causing cooperating panel segments 316 and 319 to be raised, while simultaneously pivoting about hinge 337, while panel segment 316 arcuately pivots relative to panel segment 313 about hinge member 332. Simultaneously therewith, panel segments 317 and 320 are raised, pivoting relative to each other about hinge member 338, with panel segment 317 arcuately pivoting relative to panel segment 314 about hinge member 333. Finally, cooperating panel segments 318 and 321, as depicted in FIG. 44, are raised, pivoting relative to each other about hinge member 339, while panel segment 318 pivots relative to panel segment 315, about hinge member 334. In this way, the desired back raising and leg lifting features of the present invention are attained by support system 308 so that all of the benefits detailed above are achieved by support system 308.

In addition to the back raising and leg lifting capabilities of support system 308, support system 308 also provides additional lifting or movement capabilities previously unattainable in any prior art system. In this way, any desired position changing or rolling movement of any incapacitated patient is easily attained without requiring substantial manual effort as heretofore needed. As shown in FIG. 45, panel segments 310, 313, 316, and 319 are all simultaneously raised relative to the cooperating adjacent panel segments by simultaneously inflating bladder members 350, 353, and 355.

In this way, panel segment 310 arcuately pivots relative to panel segment 311 about hinge member 325, while panel segment 313 arcuately pivots relative to panel segment 314 about hinge member 330, with panel segment 316 arcuately pivoting relative to panel segment 317 about hinge member 335 with panel segment 319 arcuately pivoting relative to panel segment 320 about hinge member 340. In this way, any individual lying on upper support member 309 is controllably moved from a substantially horizontal, prone position to a position where the individual is easily rolled or moved into an alternate location on upper support member 309, thereby relieving pressure zones and reducing the likelihood of any bedsores from being developed. By controllably inflating any desired combination of bladder members formed in support system 308, the complete movement and control of the individual in any desired position can be realized.

As is evident from the foregoing detailed disclosure, support system 308 provides a unique construction which enables individuals to be positioned in a variety of alternate supported locations on support system 308. By employing this invention, both back raising, leg raising, leg lifting, and entire body movement is controllably attained in a manner which will completely eliminate any manual lifting of individuals who are bedridden or otherwise incapacitated. As a result, a unique, highly advantageous and desirable support system is realized which eliminates problems encountered in prior art constructions.

In FIGS. 15–23, the construction of air flow control assembly 22 of the present invention is fully detailed. Throughout these drawings and the detailed disclosure associated therewith, air flow control assembly 22 is depicted in the preferred construction employed for providing the desired air delivery to one, unitary, adjustable, portable, self-contained support assembly 21. However, as previously discussed in relation to FIG. 1, two unitary support assemblies 21, 21, may be employed as part of the present invention. Consequently, the following detailed disclosure and accompanying drawings detail the construction variations required for enabling two support assemblies to be independently operated with a minimum of components.

Figure 15:
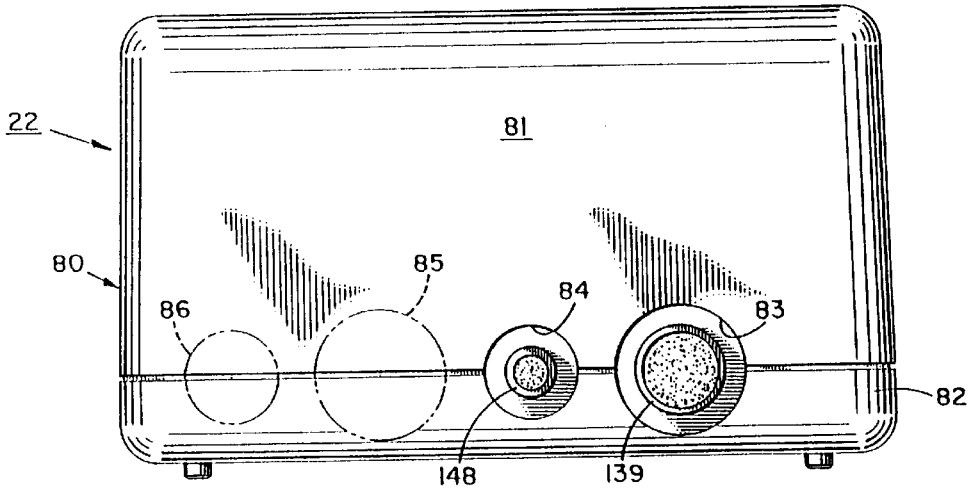
FIG. 15 is a side elevation view of the air flow control assembly which forms a part of the integrated, portable, position controlling system of the present invention.
Figure 16:
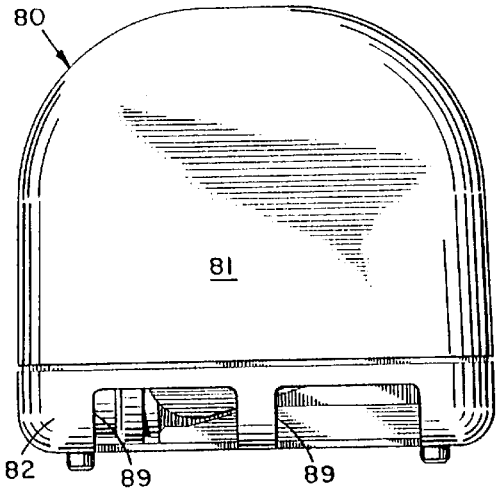
FIG. 16 is a front elevation view of the air flow control assembly of FIG. 15.

As shown in FIGS. 15 and 16, air flow control assembly 22 comprises an outer housing 80 formed by upper portion 81 and lower portion 82, which portions are matingly interconnected with each other. As shown in FIG. 15, housing 80 incorporates two portals 83 and 84 through which hoses 30 and 31 are mounted in order to obtain the desired air flow for inflating support assembly 21. In addition, as depicted in FIG. 15, when air flow control assembly 22 is constructed for use with two adjacent, unitary support assemblies 21, 21 as depicted in FIG. 1, portals 85 and 86 are also be formed in housing 80.

Figure 18:
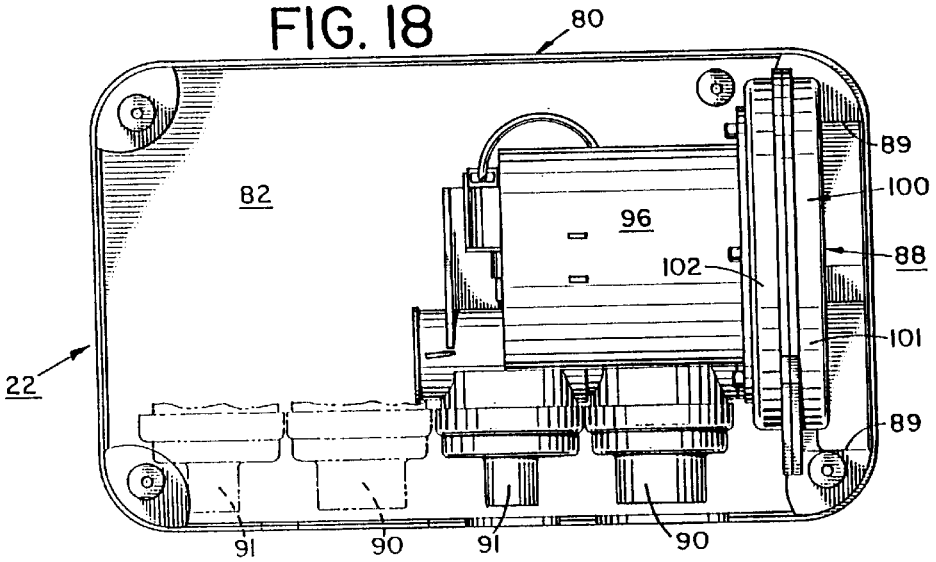
FIG. 18 is a top plan view of the air flow control assembly of FIG. 17.

In order to provide the desired air flow for inflating both bladder controlled frame assembly 35 and panel member 36 of unitary, self-contained support assembly 21, housing 80 of air flow control assembly 22 incorporates a motor assembly 88 and flow controlling valve assemblies 90 and 91. As depicted in FIG. 18, when air flow control assembly 22 is constructed for delivering the air flow to two independent, adjacent, unitary support assemblies 21, 21, as depicted in FIG. 1, a second set of air controlled valve assemblies 90, 91 are mounted in housing 80, as depicted in FIG. 18 in phantom.

In order to assure complete, trouble-free accessibility of air to motor assembly 88 when required, lower portion 82 of housing 80 incorporates substantially enlarged cut out zones 89 formed therein. By incorporating two enlarged cut out zones 89 in lower portion of housing 80, ambient air is easily drawn into housing 80 for delivery to motor assembly 88 with complete ease and without incurring any noise or possibility of blockage.

By referring to FIGS. 17 through 20, along with the following detailed disclosure, the construction and operation of motor assembly 88 can best be understood. As shown therein, motor assembly 88 comprises a conventional electrical motor 95 which is retained within motor housing 96. In the preferred construction, motor housing 96 peripherally surrounds and completely envelopes motor 95 in order to assist in reducing the noise typically associated with motor 95 when activated.

In the typical construction, motor 95 comprises a rotationally driven shaft 97 to which pump fan blade assembly 98 is securely affixed for being rotationally driven thereby. In order to assure the proper position of rotationally driven fan blade assembly 98, bushing 99 is mounted on shaft 97 between pump fan blade assembly 98 and motor 95.

Figure 17:
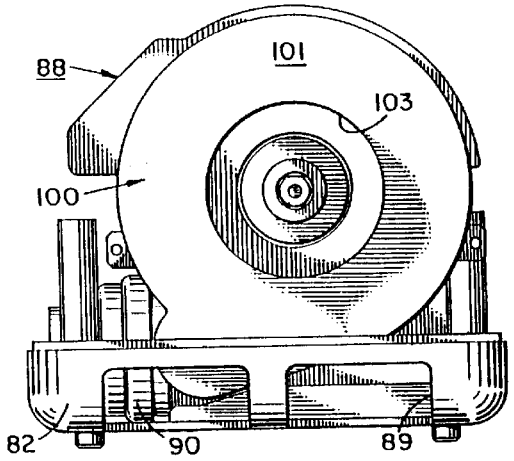
FIG. 17 is a front elevation view of the air flow control assembly of FIG. 15 with the upper portion of the housing removed.

In order to control and properly channel the air flow achieved by the rotation of pump fan blade assembly 98, fan blade assembly 98 is peripherally surrounded and sealingly contained within fan blade housing 100 which is formed by inlet bearing portion 101 and outlet bearing portion 102. As depicted in FIG. 17, inlet bearing portion 101 of housing 100 incorporates a substantially enlarged air inlet portal 103 through which the external air can flow from the outside atmosphere directly into housing 100 for being driven in the desired direction by rotating fan blade assembly 98.

Figure 19:
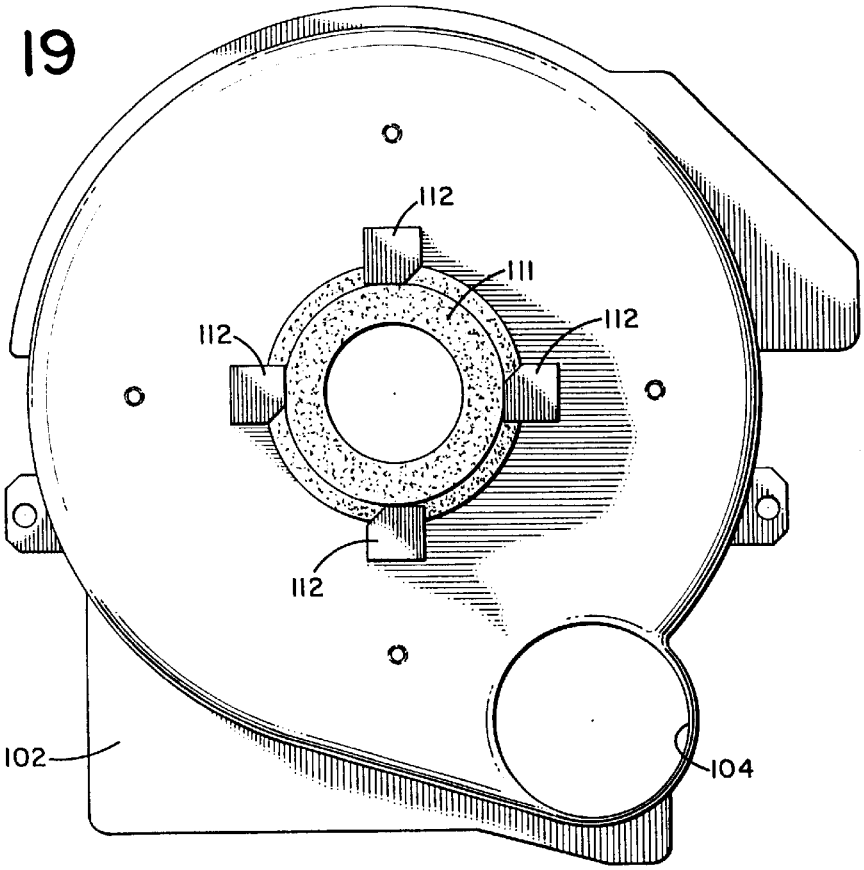
FIG. 19 is a rear elevation view of the fan blade assembly housing forming a part of the air flow control assembly of the present invention.

As shown in FIG. 19, outlet bearing portion 102 of fan housing 100 comprises an outlet portal 104 through which the air flow generated by motor 95 and pump fan blade assembly 98 is channeled. In this way, whenever motor assembly 98 is activated, the air from outside housing 80 is drawn into pump fan blade assembly 98 and delivered to outlet 104 for subsequent delivery to support assembly 21, as detailed below.

As previously discussed, one of the principal objections found in most prior art constructions is the noise caused by the motor when the motor is running. This problem is not only found in position controlling system of the nature herein described, but has been generally found in any electrically driven motor. This problem is typically caused by the inherent vibration caused by the motor during its operation and the transmittal of these vibrations to the housing in which the motor is contained. However, in the present invention, this continuing, previously unsolved complaint has been virtually eliminated.

Figure 20:
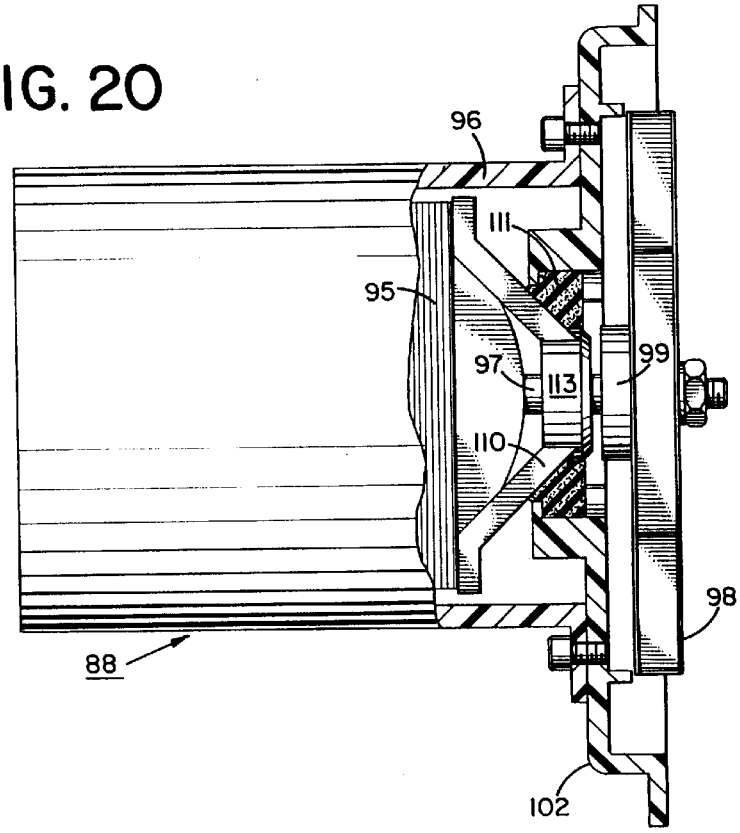
FIG. 20 is a top plan view, partially in cross-section and partially broken away, of the motor assembly incorporated into the air flow control assembly of the present invention.

By referring to FIGS. 19 and 20, the unique suspended construction of motor 95 to achieve a virtually vibration free environment is clearly shown. As depicted therein, motor 95 is supported by frame 110 through which rotating shaft 97 passes. In most typical prior art constructions, motor 95 is securely held by attaching motor 95 to a support position within its housing or by affixing frame 110 to the housing. However, by employing this prior art construction, it has been found that the vibration caused by motor 95 is transferred to the supporting housing, causing the objectionable vibration induced hum or noise which has plagued the industry.

In the present invention, this prior art problem is completely eliminated by suspending motor 95 and frame 110 in foam block 111 which is affixed to outlet bearing portion 102 of fan housing 100, while also peripherally surrounding and supportingly holding frame 110 and motor 95. In the preferred construction, foam block 111 comprises a substantially toroidal shape and is securely mounted to the outside surface of outlet bearing portion 102 of fan housing 100 by employing a plurality of upstanding, peripherally surrounding retaining clips 112. Preferably, retaining clips 112 are either formed as an integral part of outlet bearing portion 102 of fan housing 100 or are individually securely bonded directly to the outside surface of outlet bearing portion 102.

When placed in the precisely desired position, retaining clips 102 peripherally surround and securely embrace foam blocks 111 which incorporate a centrally disposed open zone 114 which is constructed for peripherally surrounding and securely embracing annular portion 113 of frame 110. By employing this construction, motor 95 with frame 110 is securely mounted and retained within peripherally surrounding housing 96 for secure, trouble-free operation, while foam block 111 provides motor 95 with a vibration absorbing, peripherally surrounding and supporting environment which prevents any vibration of motor 95 to be transmitted to housing 96 or housing 100. As a result, the objectionable hum or noise typically associated with an operating motor is virtually eliminated.

Figure 27:
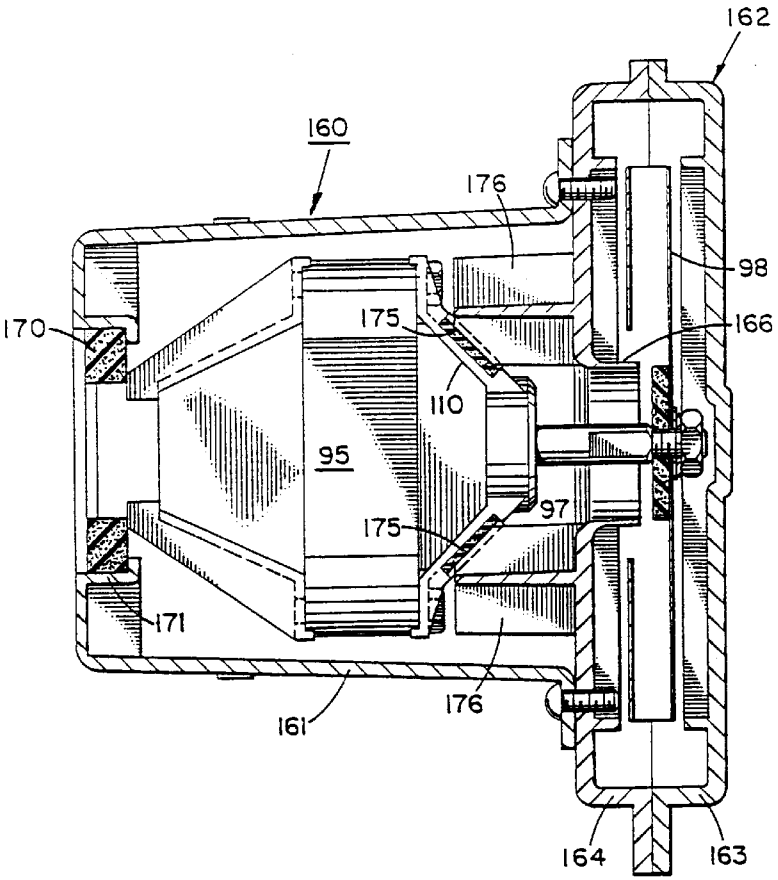
FIG. 27 is a cross-sectional, side elevation view of the motor assembly of FIG. 26, taken along line 27—27 of FIG. 26.
Figure 26:
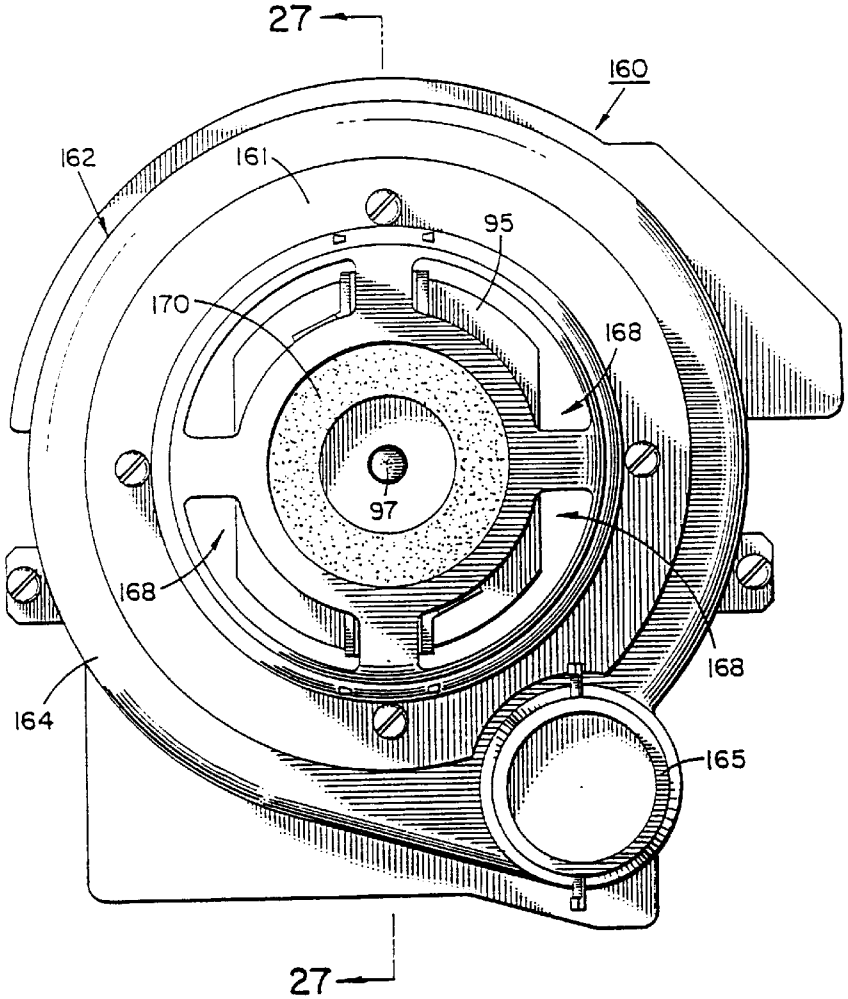
FIG. 26 is an end view of an alternate embodiment of the motor assembly of the present invention.

In FIGS. 26 and 27, an alternate motor assembly construction is depicted. In this construction, motor assembly 160 comprises a conventional electrical motor 95 which is retained within motor housing 161. As with the previous embodiment, motor housing 161 peripherally surrounds and completely envelopes motor 95 in order to assist in reducing the noise typically associated with motor 95, when activated.

As with the previous embodiment, motor 95 comprises a rotationally driven shaft 97 to which pump fan blade assembly 98 is securely affixed for being rotationally driven thereby. In this embodiment, the positioning of rotationally driven fan assembly 98 is achieved using conventional washers and locking rings.

The construction of motor assembly 160 is completed by peripherally surrounding and enveloping pump fan blade assembly 98 with a fan blade housing 162. Preferably, fan blade housing 162 comprises two matingly interengaged and abutting portions 163 and 164.

In this embodiment, portion 164 of fan blade housing 162 incorporates an inlet portal 166 and an outlet portal 165 integrally formed thereon. In addition, portion 165 also incorporates a plurality of upstanding flanges 176 spaced about inlet portal 166 and positioned for supporting engagement with motor 95.

As clearly shown in FIG. 26, motor housing 161 incorporates a plurality of open zones 168 formed in the end wall of motor housing 161. In this way, air flow through motor housing 161 is easily achieved in order to assure motor 95 is continuously being cooled during its operation.

In the preferred operation of this alternate embodiment, when motor 95 is activated, shaft 97 is rotated causing pump fan blade assembly 98 to rotate therewith. The rotation of pump fan blade assembly 98 causes air to be drawn from outside of motor housing 161 into housing 161 through apertures 168. As the air is drawn through apertures 168, the air flow passes over motor 95, thereby cooling motor 95 as the flow exits through portal 166 into fan blade housing 162. The air flow is then forced by pump fan blade assembly 98 through housing 162 and pumped out from housing 162 through outlet portal 165 to support assembly 21.

By employing this embodiment, conventional cooling fans typically associated with the motor are eliminated and the noise associated with the cooling fans is also eliminated. In addition, motor 95 is able to rotate at a slower speed, thereby further reducing the noise level generated by prior art motors.

Furthermore, by employing this alternate embodiment, it has been found that motor 95 is capable of being completely cooled through its normal operation. By constructing motor housing 161 in the manner detailed above, the motor induced air flow is drawn over the motor prior to being delivered to pump fan blade assembly 98, thereby using this air flow to cool motor 95 during its normal operation.

In addition to being able to achieve a motor which is capable of operating at a slower speed, while also eliminating the need for a cooling fan and the noise associated therewith, this alternate embodiment further reduces the noise level associated with conventional motors by employing a unique mounting construction. In this embodiment, motor 95 is mounted at both of its opposed ends in a completely, suspended arrangement, virtually isolating motor 95 from motor housing 161 and preventing any motor vibration from being transmitted to housing 161.

In this embodiment, the distal end of motor 95 is peripherally surrounded and supportingly held by foam block 170. In the preferred construction, foam block 170 comprises a substantially annular toroidal shape which is retained by a circular flange 171 formed as part of motor housing 161. By employing this construction, the distal end of motor 195 is completely suspended and effectively isolated from housing 161. As a result, any vibration that is caused during the operation of motor 95 is easily absorbed by foam block 170, preventing any transferral of the vibration to housing 161.

In addition, in this embodiment, motor 95 is also supported at its proximal end in a manner which also substantially isolates motor 95 from housing 161, preventing the vibration of motor 95 from being transferred to motor housing 161. As shown in FIG. 27, in the preferred embodiment, the proximal end of motor 95 is supported by mounting foam pads 175 to frame 110 of motor 95, in position for having outwardly extending flanges 176 of portion 164 of pump fan blade housing 162 being brought into mating, supporting contacting engagement with pads 175. In this way, upstanding flanges 176 of fan blade housing 162 extend from the surface of portion 164 into juxtaposed, spaced, cooperating relationship with frame 110 of motor 95. However, by sandwiching foam pads 175 between flanges 176 and frame 110, any vibration of motor 95 during its use is not transmitted to housing 162 by flanges 176. As a result, vibration induced noised is substantially reduced to the point where it is virtually eliminated.

By employing this alternate construction, motor 95 is securely mounted within peripherally surrounding housing 161 for secure, trouble-free operation, while being substantially suspended in its mounted position at both its proximal and distal ends by employing supportingly holding and retaining foam blocks 170 and 175. As a result, any vibration of motor 195 is effectively isolated and absorbed by the foam supporting components, preventing the vibration of motor 95 from being transmitted to motor housing 161 or fan blade housing 162. In this way, the objectionable hum or noise typically associated with an operating motor is virtually eliminated.

Figure 21:
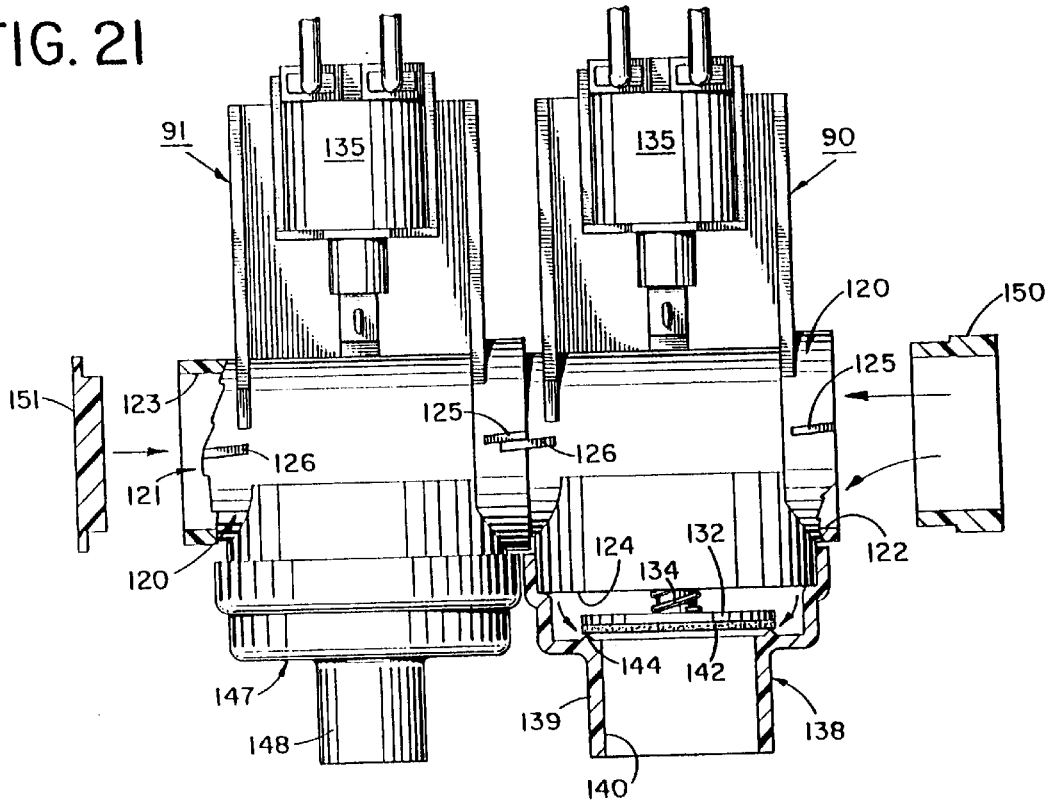
FIG. 21 are top plan views, partially in cross-section and partially broken away, showing the air control valve assemblies which form a part of the air flow control assembly of the present invention.
Figure 22:
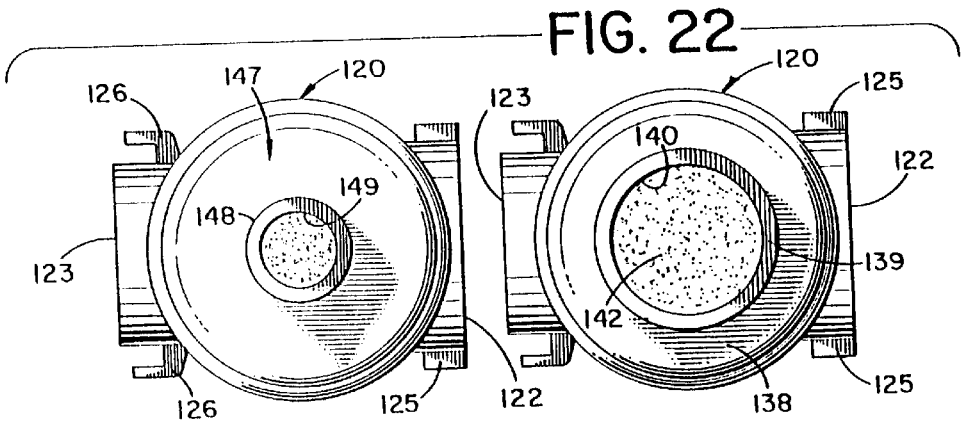
FIG. 22 is a front elevation view of the air control valve assemblies of FIG. 21.
Figure 23:
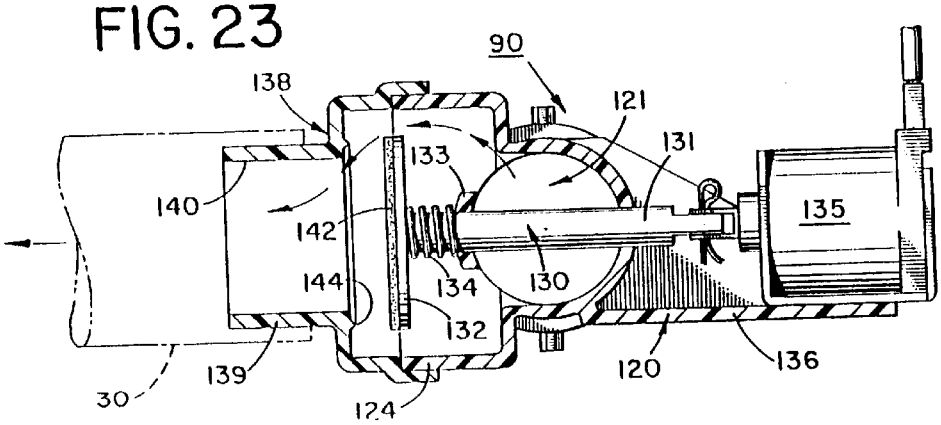
FIG. 23 is a cross-sectional side elevation view of one of the air control valve assemblies of FIG. 21.

By referring to FIGS. 21, 22 and 23, along with the following detailed disclosure, the construction and operation of the unique, highly efficient and comparatively inexpensive air control valve assemblies 90 and 91 can best be understood. In addition, as will be apparent from this disclosure, the air control valve assemblies 90 and 91, along with their associated components, are capable of providing a dependable, repeatable, safe and efficient controlled movement of the unitary, portable, support assembly 21 of this invention.

In the preferred embodiment, air control valve assemblies 90 and 91 are constructed by employing an identically sized and shaped housing 120. Housing 120 incorporates an interior chamber 121 which communicates with an inlet portal 122, a first outlet portal 123, and a second outlet portal 124.

Preferably, portal 123 and portal 122 are dimensioned for mating, locking, frictional interengagement with each other. In this preferred construction, portal 123 comprises an outer diameter substantially equivalent to the inner diameter of portal 122. As a result, two identically shaped housings 120, 120 are quickly and easily interconnected with each other by merely inserting portal 123 into portal 122. In addition, each housing 120 preferably incorporates upstanding tabs 125 positioned about portal 122 and upstanding tabs 126 positioned about portal 123. As depicted in FIG. 21, when two housings 120 are mounted in secure, frictional interengagement with each other, tabs 125 and 126 are placed in abutting contact with each other, thereby assuring that housings 120, 120 are oriented in the precisely desired position.

Each housing 120 is constructed to receive air flow through portal 122 and allow the air to flow through interior chamber 121, exiting through outlet portals 123 and 124. As a result, when two housings 120, 120 are mounted in secure, frictional interengagement with each other, as depicted in FIG. 21, air flowing into the first housing 120 through open portal 122 will be able to pass through interior chamber 121 of the first housing 120 as well as through interior chamber 121 of the second housing by exiting outlet portal 123 of the first housing and simultaneously entering inlet portal 122 of the second housing 120.

In this way, any desired number of housings can be quickly and easily matingly interconnected with each other to provide any desired number of air controlled valve assemblies 90 and 91. As a result, the desired controlled air flow for a single support assembly or a double support assembly can be achieved quickly, easily, and comparatively inexpensively.

In order to attain the desired, fully controllable valve assembly 90 or 91, each valve assembly incorporates a piston 130 which comprises an elongated rod 131 which terminates at one end thereof with a substantially flat plate 132. In the preferred embodiment, elongated piston rod 131 is axially movable within housing 120, supported for this axial movability by support arm 133.

In addition, spring means 134 is positioned on elongated rod 131 between support arm 133 and plate 132. In this way, spring means 134 continuously biases piston 130 with plate 132 being continuously maintained in its fully extended, forwardmost position, outwardly from portal 124.

In order to enable piston 130 to be axially movable, from its fully extended position (FIG. 21) to its fully retracted position (FIG. 23), the opposed end of rod 131 is affixed to solenoid 135. In this construction, whenever solenoid 135 is activated, piston 130 is drawn toward solenoid 135 along the axis of rod 131, causing plate 132 to be moved into biasing, compressing engagement of spring means 134 between plate 132 and support arm 133.

In order to complete the construction of air control valve assembly 90, a portal cover 138 is mounted in secure, sealed interengagement with portal 124 of housing 120. In addition, portal cover 138 incorporates a tubular extension 139 integrally formed therewith which incorporates a centrally disposed portal 140. Portal 140 of tubular extension 139 is completely unobstructed, communicating directly with portal 124 of housing 120. In this way, outlet 124 of housing 120 is effectively extended to portal 140.

In the preferred embodiment, tubular extension 139 comprises an outer diameter which is constructed for mating, secure mounted interengagement with air delivery hose 30. When hose 30 is mounted to tubular extension 139, the air exiting portal 124 of housing 20 is delivered to hose 30 for filling bladder control frame system 35.

In its preferred construction, plate 132 of piston 130 incorporates a soft, compressible layer 142 of air sealing material. In addition, portal cover 138 is dimensioned to assure that the inside surface of portal cover 138 is continuously maintained in secure, contacting interengagement with compressible layer 142 when piston 130 is in its normal, spring biased forward position. In this way, when solenoid 135 is not activated, portal 140 is normally maintained in a closed or sealed configuration, preventing any air from flowing into hose 30. This position is clearly shown in FIG. 21.

In addition, in order to further enhance and provide a safe, dependable, sealed closure of portal 40, portal cover 138 incorporates an upstanding circular ridge 144 formed on the inside surface thereof for mating, contacting, sealing interengagement with compressible sealing layer 142. In this way, the desired, sealed closure of portal 140 is assured.

As detailed herein, the construction of air control valve assembly 90 and air control valve assembly 91 are virtually identical, in order to obtain the cost reduction benefits realized by standardized, identical parts. As a result, air control valve assembly 91 is constructed virtually identical to the construction detailed above in reference to air control valve assembly 90. The only structural differences incorporated into air control valve assembly 91 is the use of a portal cover 147 which differs only in tubular extension 148 being constructed with a smaller diameter than tubular extension 139. Similarly, portal 149 defined by tubular extension 148 also comprises a smaller diameter.

Due to the fact that the air flow required for inflating panel member 36 is substantially less than the air flow required for inflating bladder control frame system 35, the air delivery hose 31 comprises a smaller diameter than air delivery hose 30. As a result, tubular extension 148 comprises an outer diameter which corresponds to the inner diameter of hose 31, in order to enable hose 31 to be securely affixed to extension 148, thereby providing the desired air flow.

Since the exit portal 149 of portal cover 148 is smaller than the exit portal of cover 138, the piston plate cooperating with portal cover 147 also preferably comprises a smaller diameter. In this way, all of the component parts associated with portal cover 147 comprise cooperating dimensions. However, their construction and operation is identical to the construction and operation detailed above in reference to portal cover 138.

In order to attain a quickly and easily assembled construction wherein the air exiting from portal 104 of fan housing 100 is efficiently delivered to support assembly 21, a simple interconnecting boss 150, shown in FIG. 21, is employed. Boss 150 is dimensioned for secure, frictional interengagement with portal 122 of housing 120 while the opposed end of boss 150 is constructed for secure, frictional, locked interengagement with exit portal 104 of fan housing 100. In this way, the air exiting through exit portal 104 is efficiently delivered directly to air control valve assemblies 90 and 91.

The final component required in order to complete this construction is plug 151 shown in FIG. 21. Plug 151 is inserted in portal 123 of air control valve assembly 91 in order to prevent any air from flowing out of portal 123. In this way, assurance is provided that the air flow is properly channeled only to the desired locations, and no air flow is lost to unwanted open portals.

As is now apparent from the preceding detailed disclosure, the present invention attains an air flow control assembly 22 which is comparatively inexpensively manufactured while being capable of delivering all of the desired air flow to a single, unitary support assembly 21 of this invention. In addition, if two support assemblies 21 are desired, additional housings 120 are mounted to air control valve assemblies 90 and 91 in order to attain a second set of identically constructed air control valve assemblies 90 and 91. In this way, a second unitary support assembly can be efficiently and independently controlled without requiring a separate motor and without requiring expensive complicated air flow controlling components.

Using conventional, well-known wiring techniques and switch means, motor 95 and solenoids 135 are connected to operate on conventional, household current. In addition, the control means detailed above are connected to motor 95 and solenoids 135 using conventional, well-known techniques and hardware to attain activation and deactivation whenever desired. In the preferred construction, each control means has two separate rocker switches which are normally maintained in the off position. One rocker switch is employed to operate the inflation and deflation of bladder control frame assembly 35, while the other rocker switch is constructed to operate the inflation and deflation of panel member 36.

When the activation of bladder control frame assembly 35 is desired, one of the rocker switches would be pressed which is connected to cause motor 95 to be activated while also causing solenoid 135 of air control valve assembly 90 to be activated. As a result, solenoid 135 causes piston 130 to be moved out of sealed interengagement with ridge 144 of portal cover 138, thereby opening portal 140.

The air flow caused by the operation of motor 95 and its associated fan blade assembly causes air to enter air control valve assembly 90 and exit through portal 140 into hose 30. As previously detailed, hose 30 is connected directly to air control frame assembly 35. As a result, all of the air flow caused by the operation of motor 95 is directed into bladder control frame system 35, causing frame member 50 to arcuately pivot relatively to frame member 51. As frame member 50 pivots, the back supporting portion of support assembly 21 is elevated into the precisely desired position.

Once the desired position has been reached, the user merely removes activation pressure from the rocker switch, thereby causing the rocker switch to automatically go back to the off position. Once in the off position, motor 95 is stopped and solenoid 135 is deactivated, causing piston 130 to return into sealed interengagement with ridge 144 of cover 138.

Due to the forces caused by spring 134 of air control valve assembly 90, piston 130 sealingly closes portal 140, preventing any air flow either into hose 30 from interior chamber 121 or into interior chamber 121 from hose 30. As a result, the desired elevated position of support assembly 21 is maintained.

Whenever deflation of support assembly 21 is desired, the user merely presses the rocker switch into its alternate active position which causes solenoid 135 of air control valve assembly 90 to be activated, opening portal 140. Once open, all of the air in bladder control frame assembly 35 is able to escape back into the atmosphere through portal 140 into valve housing 120, out of housing 120 through portal 122 and into fan blade housing 100. The air then exists from fan blade housing 100 through portal 103, thereby allowing the air to exit directly into housing 80. With housing 80 being in continuous communication with the outside air through enlarged cut out zones 89, the air from bladder control frame assembly 35 simply, easily, and automatically exits through the delivery system back to ambient surroundings.

As previously discussed in detail, the elastic forces of shroud 37 places compressive forces on bladder control frame assembly 35, thereby causing bladder 52 of bladder control frame assembly 35 to be forced into its deflated position, simultaneously forcing all of the air contained within bladder 52 outwardly through hose 30, valve assembly 90, fan blade housing 100 and housing 80. During the inflation of bladder controlled frame assembly 35, no inflation of panel member 36 is realized, since portal 149 of portal cover 147 is maintained in sealed interengagement. Consequently, flow through portal 149 into hose 31 is prevented.

Whenever the user desires inflation of panel member 36, the second switch of the control means is pressed into its first active position which is constructed for powering motor 95 and solenoid 135 of air control valve assembly 91. In a similar manner detailed above, the activation of solenoid 135 of air control valve assembly 91 causes the piston associated therewith to be retracted from sealing engagement with portal 149, opening portal 149 to the air flow caused by the operation of motor 95. Consequently, air is delivered through portal 149 to hose 31 and into panel member 36, to cause the desired inflation thereof.

Although the air flowing through portal 149 from fan blade housing 100 has first passed through air control valve assembly 90, no air flow through portal 140 to the bladder controlled frame system 35 is possible since piston 130 is maintained in secure, sealed, biased engagement with portal cover 138, thereby sealing portal 140 and preventing any air flow therethrough.

Once the panel member 36 has been inflated to the desired level, the user merely removes the activation force from the rocker switch, which automatically stops motor 95 from operating and causes the piston of air control valve assembly 91 to be returned into sealed, closing engagement with cover 147. This position is then maintained as long as the user desires.

Once deflation of panel member 136 is sought, the rocker switch is moved into its alternate active position, which causes solenoid 135 to move the piston associated therewith to move into the open position, thereby allowing all of the air within panel member 136 to be forced in the reverse direction through portal 149, air control valve assembly 90 and 91, blade housing 100, and housing 80.

It has been found that no motor driven suction is required to withdraw the air from either bladder control frame assembly 35 or panel member 36. As detailed above, the elastic forces of shroud 37 are sufficient to assure that the bladder control frame assembly is completely deflated, when desired, without requiring expensive operational components. Similarly, by the user merely maintaining his legs in position on support assembly 21, air within panel member 36 is easily forced through the open passageway detailed above, until fully deflated. Of course, once the panel member has been fully deflated, the user merely removes the activation force from the rocker switch, causing the rocker switch to move into its normally off position and simultaneously causing the piston of air controlled valve assembly 91 to be moved by the spring means associated therewith into its sealed engagement with portal cover 147.

Figure 33:
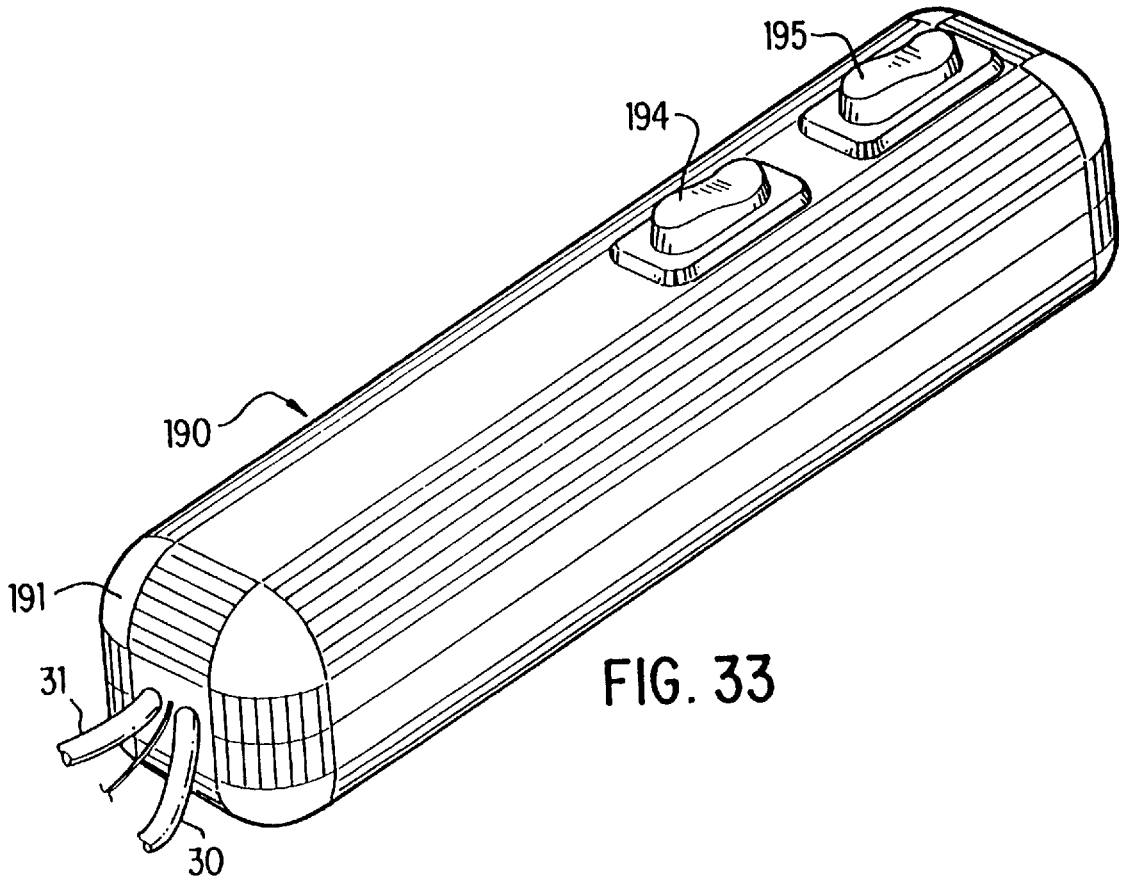
FIG. 33 is a perspective view of an alternate construction of an air flow control assembly of the present invention.
Figure 34:
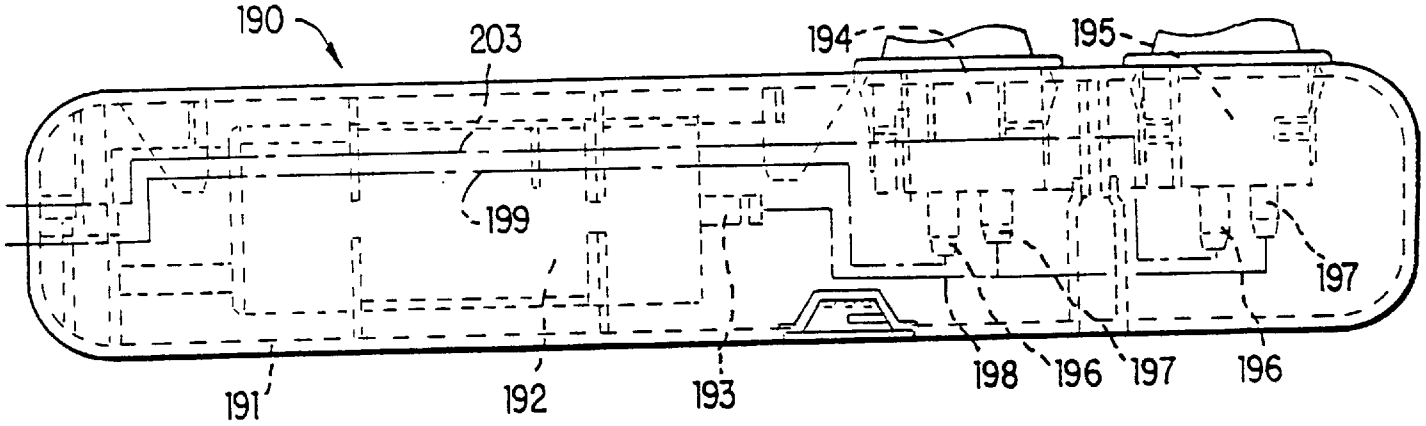
FIG. 34 is a cross-sectional side elevation view of the air flow control assembly of FIG. 33.

In FIGS. 33 and 34, an alternate construction of an air flow control system is depicted. In this embodiment, a unique, fully integrated, hand holdable air flow control assembly 190 is detailed which integrates into a single, hand holdable construction, the functions detailed above in reference to control means 23 and air flow control assembly 22. By providing the functions detailed above in reference to air flow control assembly 22, as well as control means 23, in a single, compact, easily held and transported construction, a unique, substantial advance over prior art constructions is realized.

In the preferred embodiment, integrated, hand holdable, air flow control assembly 190 comprises an outer housing 191 which is preferably formed of an upper portion and a lower portion matingly interengaged with each other. Securely mounted within housing 191 is a miniature pump/motor 192. The overall construction of pump/motor 192 is generally known in the prior art and comprises a miniaturized construction, capable of combining these functions in a single, compact structure.

Air delivery portal 193 extends from pump/motor 192 and forms the portal through which the pressurized air flow of pump/motor 192 is delivered. Typically, inlet holes are formed in the outer casing of pump/motor 192 to provide the air flow required by pump/motor 192 for generating the desired pressurized air flow output.

Also mounted in housing 191 of air flow control assembly 190 are two separate and independent switch means 194 and 195. In the preferred construction, both switch means 194 and 195 comprise three position switches, which are able to simultaneously actuate both electrical and mechanical components, when required. In addition, as clearly shown in FIG. 34, each switch means 194 and 195 incorporate two separate and independent air flow portals 196 and 197.

By referring to FIG. 34, along with the following detailed discussion, the air flow interconnections employed in air flow control assembly 190 can best be understood. For purposes of clarity, dotted lines have been employed as representing tubing interconnections between the components contained within air flow control assembly 190. As is evident to one of ordinary skill in the art, tubing is employed for conducting the desired air flow. However, for purposes of clarity and ease of explanation, as well as ease of understanding, dotted lines have been employed as representing the internal tubing incorporated therein.

As shown in FIG. 34, portal 193 of pump/motor 192 is connected to tubing 198 which is connected to portal 197 of switch means 194 and portal 197 of switch means 195. As is evident to one of ordinary skill in the art, this dual connection is easily attained by employing a "Y" or "T" connection in tubing 198.

Furthermore, in order to provide the requisite air flow delivery to air flow tubes 30 and 31, for enabling bladder control frame assembly 35 and panel member 36 to be inflated or deflated, tubing 199 is connected to portal 196 of switch means 194. The opposed end of tubing 199 exits housing 190 and is connected to tubing 30. In this way, the desired air flow is delivered to bladder control frame assembly 35.

Finally, in order to provide air flow to panel member 36, portal 196 of switch means 195 is connected to tubing 193 which is constructed for exiting from housing 191 where it is connected to air flow tube 31 for providing the desired air flow to panel member 36. In this way, the desired controlled air flow for both bladder control frame assembly 35 and panel member 36 is realized.

In its typical construction, each switch means 194 and 195 comprise a rocker-type construction which is spring biased to provide a first activated position, when one side of the switch means is pressed, and a second activating position, when the opposed side of the switch is pressed. If no activation force is applied, the switch remains in its normal mid position.

In the normal mid position, switch means 194 and 195 are constructed to maintain both air portals 196 and 197 thereof in a closed position with the electrical contact in the OPEN position. In this way, no air flows through switch means 194 and 195 and the pump/motor remains inactive.

When switch means 194 and 195 are activated into their first position, the electrical contacts are closed, thereby causing power to be delivered to pump/motor 192, activating pump/motor 192 to generate the pressurized air flow through portal 193. In addition, the mechanical portion of switch means 194 and 195 simultaneously opens and interconnects air flow portals 196 and 197.

Whenever switch means 194 or switch means 195 are activated into this first position, pump/motor 192 is activated, causing pressurized air to be delivered through portal 193. This air flow is transmitted through tubing 198 to portal 197 of switch means 194 and portal 197 of switch means 195. As diagrammatically represented in FIG. 34, and discussed above, this is achieved by incorporating a "Y" or "T" along the length of tubing 198 so as to enable this air flow to be connected to portal 197 of switch means 194 and portal 197 of switch means 195.

As previously detailed, whenever switch means 194 is activated into its first alternate position, air flow portal 196 is also opened and interconnected with portal 197. As a result, the air flow entering portal 197 from pump/motor 192 passes through switch means 194 and outwardly therefrom through air portal 196. This air flow is then channeled through tubing 199 to air delivery hose 30 for inflating the bladder associated with bladder control frame assembly 35. In this way, by merely activating switch means 194 into its first alternate position, the desired movement of bladder control frame assembly 35 is achieved and any desired elevated position sought by the user is easily attained.

Similarly, whenever switch means 195 is activated into its first alternate position, the air flow from activated pump motor 192 is delivered through portal 197 to portal 196 of switch means 195. Upon exiting portal 196 of switch means 195, the air flow is conducted by tubing 203 to air delivery hose 31. As previously discussed, air delivery hose 31 is connected to panel member 36, causing panel member 36 to be inflated, thereby enabling the user to attain the desired elevation of the user's feet or legs.

Whenever deflation of bladder control frame assembly 35 or panel member 36 is desired, switch means 194 or 195 are activated into their second alternate position. When switch means 194 is activated into its second alternate position, air flow portals 196 and 197 are both opened and interconnected, while the electrical contacts are maintained in their open position. As a result, pump/motor 192 is not activated, but air flow is permitted through switch means 194.

As a result of this construction, whenever switch means 194 is activated into its second alternate position, the deflation of bladder control frame assembly 35 is attained. This deflation is realized by having the air within the bladder of bladder control frame assembly 34 flow from the bladder through flow tube 30 and tubing 199 into portal 196 and out of portal 197 of switch means 194 for delivery to pump motor 192. The venting air enters portal 193 of pump/motor 192 and passes through the pump/motor and out of the air hose on the side wall of motor 192.

In this way, all of the air contained within bladder control frame assembly 35 is allowed to vent to the atmosphere, powered only by the weight of the individual on the frame assembly. Once the desired level of deflation has been attained, the activating pressure is removed from switch means 194, allowing switch means 194 to return to its normal position with portals 196 and 197 thereof in the CLOSED position.

In a similar manner, panel member 36 is also deflated. In this instance, switch means 195 is activated into its second alternate position, thereby interconnecting portals 196 and 197 thereof, while maintaining the electrical contacts in the open position. As a result, the air contained within panel member 36 is able to flow through tube 31 and tubing 203 into portal 196 of switch means 195 and out of portal 197 to portal 193 of pump/motor 192 through tubing 198. The air entering pump/motor 192 is then allowed to vent from the pump/motor through its air hose. In this way, panel member 36 is able to deflate to any desired level. Once this level has been reached, the activation pressure is removed from switch means 195, thereby closing portal 196 and 197 thereof.

Figure 35:
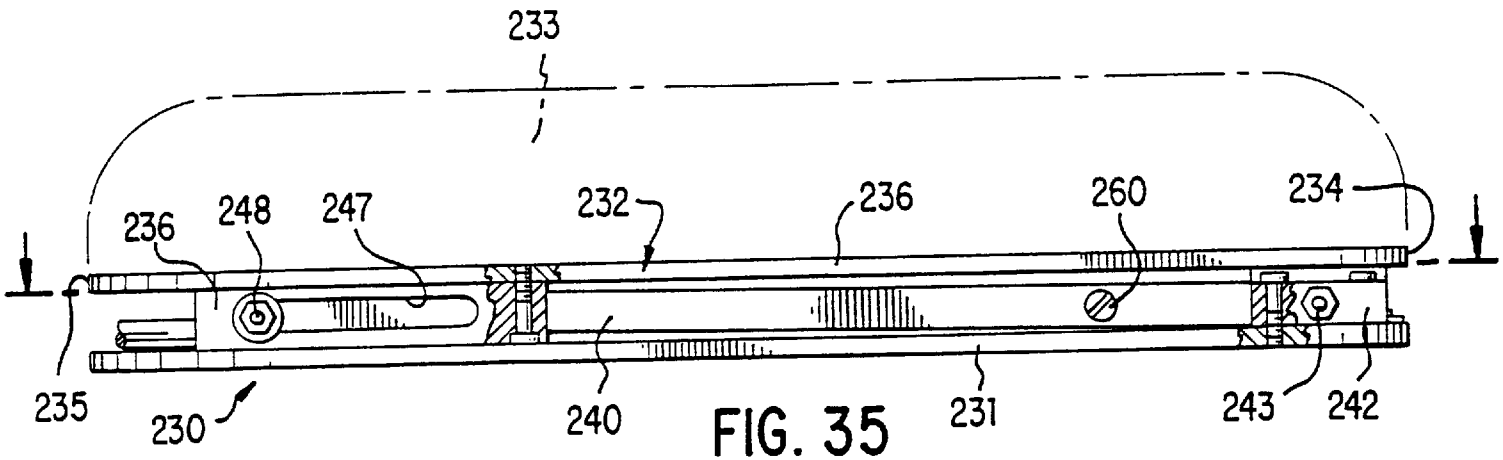
FIG. 35 is a side elevation view of a seat raising system incorporating the inflatable bladder construction of the present invention.
Figure 36:
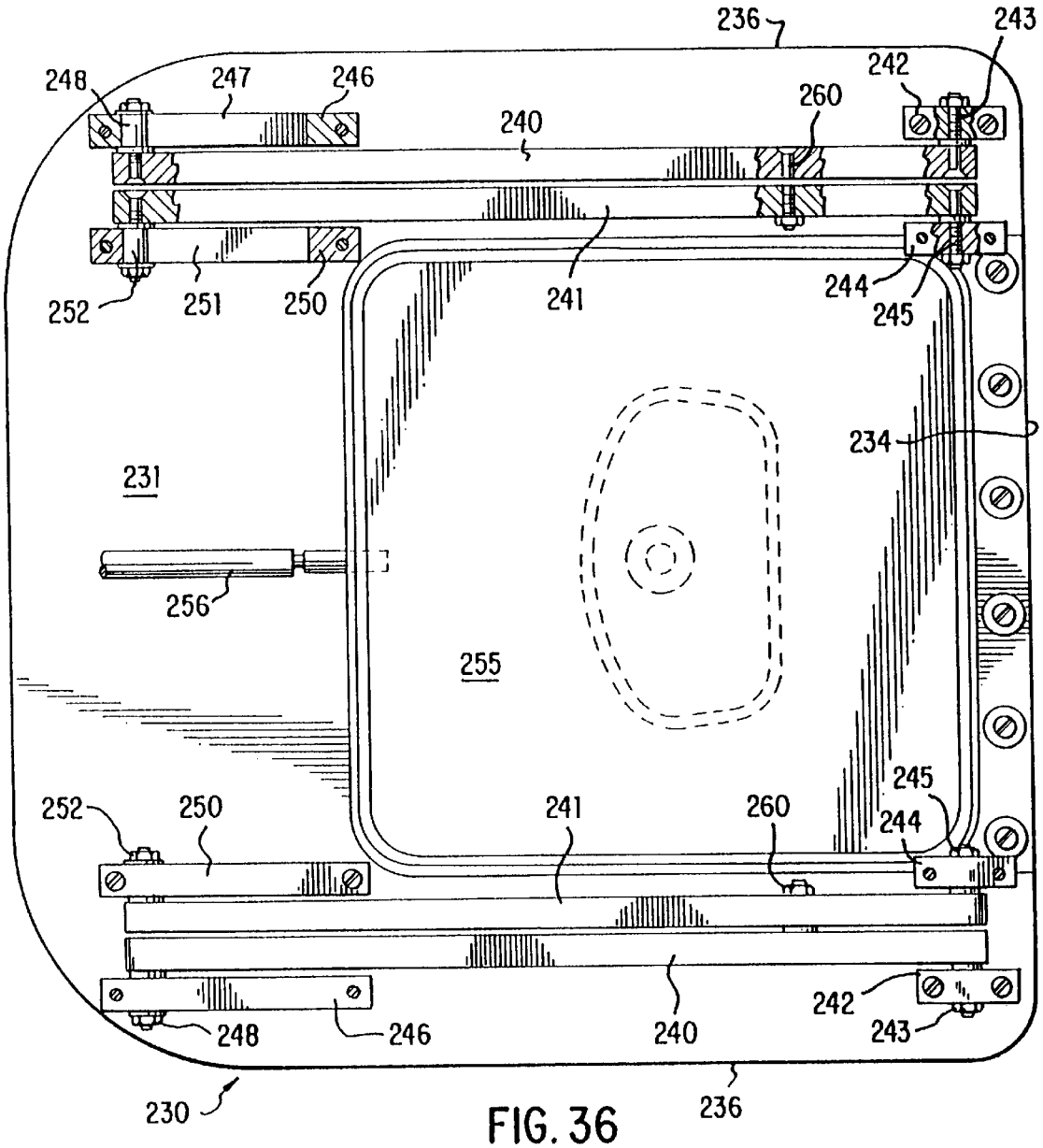
FIG. 36 is a top plan view of the seat raising system of FIG. 35, with the top support plate removed.
Figure 37:
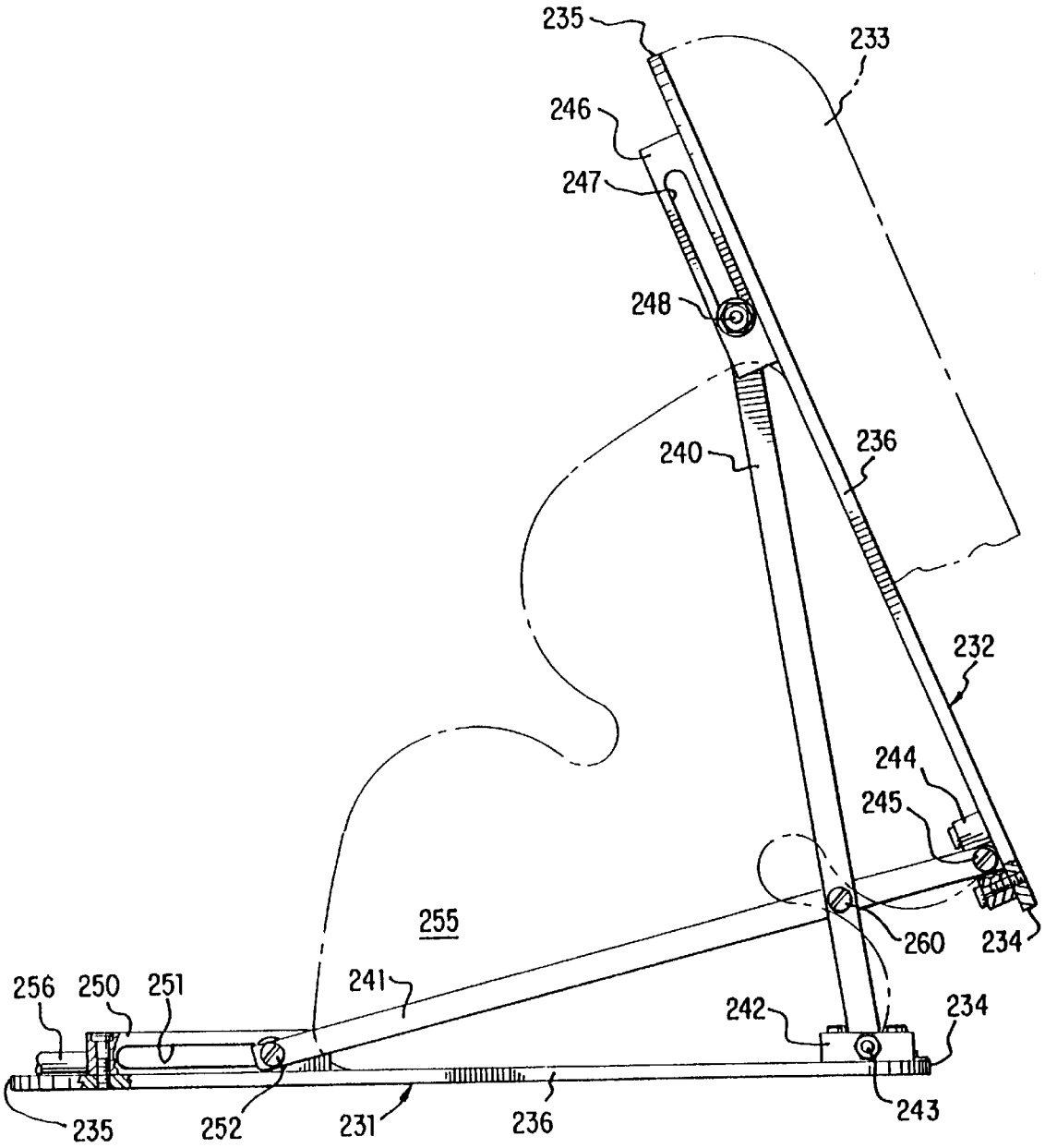
FIG. 37 is a side elevation view of the seat raising system of FIG. 35.

By referring to FIGS. 35, 36, and 37, along with the following detailed disclosure, the construction and operation of the inflatable bladder system of the present invention is detailed as applied in an alternate embodiment. In this embodiment of the present invention, a seat raising system 230 is obtained and is fully depicted and detailed herein. In dealing with many handicapped individuals, individuals suffering from various leg injuries, as well as older individuals, one principal common difficulty is the inability to move from a seated position to a standing position. Although individuals with this medical problem are often capable of walking, either assisted or unassisted, these individuals are incapable of lifting themselves from a seated position to a standing position.

Presently various raising or lifting systems are in existence in an attempt to satisfy this need. However, these presently existing systems are incapable of providing the precisely desired type of lifting required, while still being manufactured and sold at a reasonable, affordable cost.

In order to provide the precisely desired assistance required by individuals with this problem, the seat on which the individual is resting cannot be merely arcuately pivoted. It has been found that prior art systems capable of providing only arcuate pivoting motion of the seat are incapable of raising the individual to a position where the individual is capable of standing fully erect.

In order to move the individual from a seated position to a standing position, two separate and independent directions of motion must be imparted to the seat. This dual direction of motion consists of arcuate pivoting of the seat and horizontal upward movement of the seat. It has been found that it is necessary to raise the individual into a higher plane in addition to arcuately pivoting the individual forwardly. By having both arcuate pivoting motion and horizontal upward motion, the individual is moved into the required position and the individual is able to stand and walk, in the manner attainable by that individual.

In view of this dual direction of motion requirement, in order to enable an individual to be moved from a seated position to a standing position, the presently existing prior art systems are extremely complex and very expensive. However, by employing the air inflatable bladder assembly of the present invention, along with the unique movement control system detailed herein, this dual motion is attained in a construction which is substantially less expensive than prior art systems.

In the present invention, controllable seat raising system 230 comprises a base plate, 231 which is immovable, and is generally affixed to the chair to which controllable seat raising system 230 is mounted. In addition, system 230 also incorporates a movable support plate 232 which is capable of being moved through the desired combined arcuate and horizontal raising positions. In the preferred embodiment, a cushion 233, shown in phantom, is affixed to support plate 232 or is formed as a part thereof. By incorporating cushion 232, a softer, more comfortable construction is realized.

As shown throughout the drawings, both base plate 231 and support plate 232 incorporate a front or leading edge 234, a rear edge 235, and side edges 236. As is more fully detailed below, by employing controllable seat raising system 230, leading edge 234 of support plate 232 arcuately pivots relative to the leading edge of base plate 231, while also moving upwardly relative thereto.

In order to attain this desired, controlled dual-action motion, controllable seat raising system 230 incorporates a pair of movement control arms 240, 240, each of which are cooperatingly mounted with a second pair of movement control arms 241, 241. In the preferred construction, each cooperating pair of movement control arms 240 and 241 are mounted in juxtaposed, spaced adjacent relationship with each other, along the one side edge 236 of base plate 231 and support plate 232. Each pair of movement control arms 240 and 241 comprise elongated rod or channel members which extend substantially the entire length of side edge 236 and are mounted substantially parallel therewith.

Each control arm 240 is mounted for pivotal movement to an arm holding bracket 242. In order to attain fixed, arcuate pivoting motion, securement means 243 is mounted through cooperating, aligned through holes formed in one end of movement control arm 240 and arm holding bracket 242. In this way, each movement control arm 240 is mounted to base plate 231 for arcuate movement about the axis defined by securement means 243.

Each movement control arm 241 is mounted at one of its ends directly adjacent the front end 234 of support plate 232. Using a similar construction, one end of each movement control arm 241 is formed with a through hole therein and is mounted to arm holding bracket 244 by employing securement means 245. In this way, each movement control arm 241 is securely affixed to support plate 232, directly adjacent leading edge 234 thereof, for arcuate movement about the axis defined by fastening means 245.

With the first end of each movement control arm 240 pivotally mounted to base plate 241, the opposed end thereof, is mounted to support plate 232 for controlled, sliding movement relative thereto. In order to attain this sliding movement, bracket 246 is securely affixed to support plate 232 with an elongated closed channel 247 formed in bracket 246. By securely affixing fastening means 248 to the free end of control arm 240, with the fastening means also extending through and secured within channel 247, the otherwise free end of movement control arm 240 is capable of movement relative to support plate 232, within the elongated extent of channel 247.

By employing a similar construction, the otherwise free end of each control arm 241 is mounted to base plate 231 for controlled sliding movement relative thereto. In order to attain this controlled movement, two brackets 250, 250 are mounted to base plate 231 adjacent rear edge 234 thereof and positioned in juxtaposed, spaced, cooperating relationship with one of the control arms 241, 241.

Each bracket 250 incorporates a closed, elongated channel 251 formed therein, which defines the distance through which control arm 241 is capable of moving. In order to attain this desired controlled movement, the otherwise free end of the adjacent control arm 241 is mounted to fastening means 252 which extends through control arm 241 and channel 251, with fastening means 252 being slidably engaged in channel 251. In this way, each control arm 241 is mounted to base plate 231 for controlled sliding movement relative thereto within the distance allowed by the length of channel 251.

In order to provide the desired force required for moving support plate 232 relative to base plate 231, controllable seat raising system 230 also incorporates inflatable bladder 255. As with the bladder constructions detailed above, bladder 255 comprises a completely sealed construction incorporating an interior chamber which expands upon the receipt of air flow through air delivery hose 256. In order to provide the desired controlled air flow to bladder 255, air delivery hose 256 is connected to air flow control assembly 22 or 190 (not shown), both of which are fully disclosed herein.

By activating the particular air flow control assembly employed, air is delivered to bladder 255 through delivery hose 256, causing bladder 255 to inflate. This forces support plate 232 to move in the precisely desired dual directions in a controlled manner, due to the constructions and integrated controlled movements provided by control arms 240 and 241, as well as the bracket assemblies associated therewith. Of course, whenever support plate 232 is to be returned to its original position, in juxtaposed, spaced, parallel relationship to base plate 231, the means associated with the air flow control assembly employed are activated for venting the air contained within bladder 255, thereby automatically returning support plate 232 to its original position.

In order to attain the desired dual direction movement required for providing an effective lifting system for handicapped or injured individuals, pivot defining fastening means 260 is interconnectingly mounted to each pair of adjacent movement control arms 240 and 241. As best seen in FIG. 35, coaxially aligned through holes are formed in both pairs of movement control arms 240 and 241 in order to enable fastening means 260 to be inserted through the aligned through holes. In this way, each pair of control arms 240 and 241 are fastened to each other in cooperating relationship.

By mounting fastening means 260 in each pair of movement control arms 240 and 241, with the axis defined by both fastening means 260, 260 being identical, the cooperating movement of control arms 240 and 241 and its effect on the movement of support plate 232 causes support plate 232 to simultaneously move both upwardly and arcuately. By controllably positioning fastening means 260 at a desired location along the length of control arms 240 and 241, the precisely desired upward lifting and forward pivoting of support plate 232 is attained. As a result, the requisite horizontal raising of support plate 232 relative to base plate 231, as well as its arcuate movement, is achieved simultaneously in an efficient, cost effective, manner. As a result, as bladder 255 is inflated, the precisely desired movement of support plate 232 relative to base plate 231 is realized.

By mounting fastening means 260 to control arms 240 and 241, in the manner detailed above, a unique construction is attained which provides the desired dual direction of motion. The mounting of fastening means 260 along the length of control arms 240 and 241 establishes a secondary, floating pivot axis which enables support plate 232 to move upwardly simultaneously with its arcuate pivoting motion. As a result, the precisely required dual direction of motion is attained in an extremely cost efficient, elegantly simple, mechanical construction.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings have been interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A portable, self-contained, unitary, movably adjustable support assembly for enabling users to position a back-supporting portion thereof into any one of a plurality of alternate positions, said support assembly comprising:

A. a first and a second U-shaped frame member constructed for nested interengagement with each other when pivotally interconnected at their respective terminating ends, B. an air inflatable bladder a. independently interconnected with each of said frame members on adjacent surfaces thereof, and b. incorporating a sealed air retaining zone formed therein, C. air receiving portal means interconnected at a first end thereof in one surface of the bladder for communicating with the sealed air-retaining zone therein, with a second end of the portal means being constructed for interconnection with air delivery means, D. a support surface cooperatively associated with the first frame member for comfortably supporting the user, said first frame member being constructed for moving said support surface through an arcuate distance of about 80° and securely supportingly maintaining the support surface in any desired position between 0° and 80°; and E. an arcuately shaped, elongated support bar a. mounted in juxtaposed, spaced, portions of said first frame member, b. connected to the bladder for delivering the lifting force of the bladder to the first frame member, and c. biasing the frame member portions outwardly in response to the bladder lifting forces acting thereon whereby inflation of the bladder to arcuately pivot the first frame member relative to the second frame member simultaneously causes said support surface to be increasingly tightened.

2. The support assembly defined in claim 1, wherein said support surface is further defined as comprising a substantially flat panel securely affixed to each of the portions forming the first U-shaped frame member.

3. The support assembly defined in claim 2, wherein said substantially flat panel is further defined as comprising one selected from the group consisting of woven material, non-woven material, and plastic sheet material.

4. The support assembly defined in claim 1, wherein said air inflatable bladder is further defined as comprising two separate and independent air inflatable bladders mounted to said first and second frame members.

5. The support assembly defined in claim 4, wherein said dual bladders are further defined as being interconnected for simultaneous inflation.

6. The support assembly defined in claim 5, wherein said dual bladders are further defined as being mounted directly to adjacent portions of the first frame member and second frame member, thereby ensuring complete controlled pivoting motion of said first frame member relative to the second frame member.

7. The support assembly defined in claim 1, wherein said bladder is further defined as being peripherally surrounded and enveloped by cover means for providing a further enhanced visual appearance.

8. The portable, self-contained, unitary, movably adjustable support assembly defined in claim 1, wherein said support surface is further defined as comprising a rigid support panel for assuring secure, supporting retention of the movement of the user.

9. The portable, self-contained, unitary movably adjustable support assembly defined in claim 8, wherein said support surface is further defined as comprising cushioning means removably mounted thereto for further enhancing the comfort of the user.

* * * * *